US008138995B2

(12) United States Patent
Yamashita et al.

(10) Patent No.: US 8,138,995 B2
(45) Date of Patent: Mar. 20, 2012

(54) PLASMA DISPLAY DEVICE

(75) Inventors: Takeru Yamashita, Osaka (JP); Kazuki Sawa, Osaka (JP); Hiroko Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 797 days.

(21) Appl. No.: 12/296,296

(22) PCT Filed: Jan. 11, 2008

(86) PCT No.: PCT/JP2008/050229
§ 371 (c)(1),
(2), (4) Date: Oct. 7, 2008

(87) PCT Pub. No.: WO2008/087892
PCT Pub. Date: Jul. 24, 2008

(65) Prior Publication Data

US 2009/0184953 A1 Jul. 23, 2009

(30) Foreign Application Priority Data

Jan. 15, 2007 (JP) ..... 2007-005613
Feb. 22, 2007 (JP) ..... 2007-041886

(51) Int. Cl.
*G09G 3/28* (2006.01)

(52) U.S. Cl. ..... 345/63; 345/60

(58) Field of Classification Search ..... 345/212
See application file for complete search history.

(56) References Cited

U.S. PATENT DOCUMENTS 6,674,429 B1 * 1/2004 Correa et al. ..... 345/211
7,079,126 B1 * 7/2006 Correa et al. ..... 345/212
7,088,312 B2 8/2006 Ishizuka et al.
2001/0006379 A1 * 7/2001 Kasahara et al. ..... 345/60
2002/0118312 A1 * 8/2002 Ishizuka et al. ..... 348/797
2002/0154073 A1 * 10/2002 Kojima et al. ..... 345/60
2004/0104866 A1 * 6/2004 Sano et al. ..... 345/60

FOREIGN PATENT DOCUMENTS

JP 10-187093 A 7/1998
JP 10-187093 A 7/1998
JP 11-038930 A 2/1999
JP 11-038930 A 2/1999
JP 2000-066638 A 3/2000

(Continued)

OTHER PUBLICATIONS

"STV7699 plasma display panel data driver", STMircoelectronics, 1999, p. 5.*

(Continued)

*Primary Examiner* — Richard Hjerpe
*Assistant Examiner* — Dorothy Harris
(74) *Attorney, Agent, or Firm* — RatnerPrestia

(57) ABSTRACT

A plasma display device includes the following elements: an image signal conversion circuit for converting an image signal into an image data; a data electrode driver circuit for driving data electrodes according to the image data; a power calculation circuit for calculating a power consumption of the data electrode driver circuit according to the image data; and a temperature calculation circuit for calculating a temperature of the data electrode driver circuit according to the image data. The image signal conversion circuit converts the image signal into an image data decreasing the power consumption of the data electrode driver circuit at least when the calculated power consumption exceeds a predetermined power threshold value, or when the calculated temperature exceeds a predetermined temperature threshold value.

5 Claims, 16 Drawing Sheets

FOREIGN PATENT DOCUMENTS

| | | | | |
|---|---|---|---|---|
| JP | 2000-066638 | A | | 3/2000 |
| JP | 2001-109420 | A | | 4/2001 |
| JP | 2001-109420 | A | | 4/2001 |
| JP | 2002-149109 | A | | 5/2002 |
| JP | 2002149109 | A | * | 5/2002 |
| JP | 2002-258793 | A | | 9/2002 |
| JP | 2003-510655 | A | | 3/2003 |
| JP | 2003-271094 | A | | 9/2003 |
| KR | 2002-0070127 | | | 9/2002 |
| WO | WO 01/24150 | A1 | | 4/2001 |

OTHER PUBLICATIONS

"STV7622 192 output plasma display panel data driver", STMircoelectronics, 2007, pp. 16-18.*

International Search Report for International Application No. PCT/JP2008/050229, Feb. 19, 2008, Matsushita Electric Industrial Co., Ltd.

* cited by examiner

FIG. 5A

| Image signal | 1SF (1) | 2SF (2) | 3SF (3) | 4SF (6) | 5SF (11) | 6SF (18) | 7SF (30) | 8SF (44) | 9SF (60) | 10SF (80) |
|---|---|---|---|---|---|---|---|---|---|---|
| 0 | 0 | 0 | 0 | 0 | 0 | 0 | 0 | 0 | 0 | 0 |
| 1 | 1 | 0 | 0 | 0 | 0 | 0 | 0 | 0 | 0 | 0 |
| 2 | 0 | 1 | 0 | 0 | 0 | 0 | 0 | 0 | 0 | 0 |
| 3 | 1 | 1 | 0 | 0 | 0 | 0 | 0 | 0 | 0 | 0 |
| 4 | 1 | 0 | 1 | 0 | 0 | 0 | 0 | 0 | 0 | 0 |
| 5 | 0 | 1 | 1 | 0 | 0 | 0 | 0 | 0 | 0 | 0 |
| 6 | 1 | 1 | 1 | 0 | 0 | 0 | 0 | 0 | 0 | 0 |
| 7 | 1 | 0 | 0 | 1 | 0 | 0 | 0 | 0 | 0 | 0 |
| 8 | 0 | 1 | 0 | 1 | 0 | 0 | 0 | 0 | 0 | 0 |
| 9 | 1 | 1 | 0 | 1 | 0 | 0 | 0 | 0 | 0 | 0 |
| 10 | 1 | 0 | 1 | 1 | 0 | 0 | 0 | 0 | 0 | 0 |
| 11 | 0 | 1 | 1 | 1 | 0 | 0 | 0 | 0 | 0 | 0 |
| 12 | 1 | 1 | 1 | 1 | 0 | 0 | 0 | 0 | 0 | 0 |
| 13 | 0 | 1 | 0 | 0 | 1 | 0 | 0 | 0 | 0 | 0 |
| 14 | 1 | 1 | 0 | 0 | 1 | 0 | 0 | 0 | 0 | 0 |
| 15 | 1 | 0 | 1 | 0 | 1 | 0 | 0 | 0 | 0 | 0 |
| 16 | 0 | 1 | 1 | 0 | 1 | 0 | 0 | 0 | 0 | 0 |
| 17 | 1 | 1 | 1 | 0 | 1 | 0 | 0 | 0 | 0 | 0 |
| 18 | 1 | 0 | 0 | 1 | 1 | 0 | 0 | 0 | 0 | 0 |
| 19 | 0 | 1 | 0 | 1 | 1 | 0 | 0 | 0 | 0 | 0 |
| 20 | 1 | 1 | 0 | 1 | 1 | 0 | 0 | 0 | 0 | 0 |
| 21 | 1 | 0 | 1 | 1 | 1 | 0 | 0 | 0 | 0 | 0 |
| 22 | 0 | 1 | 1 | 1 | 1 | 0 | 0 | 0 | 0 | 0 |
| 23 | 1 | 1 | 1 | 1 | 1 | 0 | 0 | 0 | 0 | 0 |
| 24 | 1 | 1 | 1 | 0 | 0 | 1 | 0 | 0 | 0 | 0 |
| 245 | 0 | 1 | 0 | 0 | 1 | 1 | 1 | 1 | 1 | 1 |
| 246 | 1 | 1 | 0 | 0 | 1 | 1 | 1 | 1 | 1 | 1 |
| 247 | 1 | 0 | 1 | 0 | 1 | 1 | 1 | 1 | 1 | 1 |
| 248 | 0 | 1 | 1 | 0 | 1 | 1 | 1 | 1 | 1 | 1 |
| 249 | 1 | 1 | 1 | 0 | 1 | 1 | 1 | 1 | 1 | 1 |
| 250 | 1 | 0 | 0 | 1 | 1 | 1 | 1 | 1 | 1 | 1 |
| 251 | 0 | 1 | 0 | 1 | 1 | 1 | 1 | 1 | 1 | 1 |
| 252 | 1 | 1 | 0 | 1 | 1 | 1 | 1 | 1 | 1 | 1 |
| 253 | 1 | 0 | 1 | 1 | 1 | 1 | 1 | 1 | 1 | 1 |
| 254 | 0 | 1 | 1 | 1 | 1 | 1 | 1 | 1 | 1 | 1 |
| 255 | 1 | 1 | 1 | 1 | 1 | 1 | 1 | 1 | 1 | 1 |

FIG. 5B

| Image signal | 1SF (1) | 2SF (2) | 3SF (3) | 4SF (6) | 5SF (11) | 6SF (18) | 7SF (30) | 8SF (44) | 9SF (60) | 10SF (80) |
|---|---|---|---|---|---|---|---|---|---|---|
| 0 | 0 | 0 | 0 | 0 | 0 | 0 | 0 | 0 | 0 | 0 |
| 1 | 0 | 0 | 0 | 0 | 0 | 0 | 0 | 0 | 0 | 0 |
| 2 | 0 | 1 | 0 | 0 | 0 | 0 | 0 | 0 | 0 | 0 |
| 3 | 0 | 1 | 0 | 0 | 0 | 0 | 0 | 0 | 0 | 0 |
| 4 | 0 | 0 | 1 | 0 | 0 | 0 | 0 | 0 | 0 | 0 |
| 5 | 0 | 1 | 1 | 0 | 0 | 0 | 0 | 0 | 0 | 0 |
| 6 | 0 | 1 | 1 | 0 | 0 | 0 | 0 | 0 | 0 | 0 |
| 7 | 0 | 0 | 0 | 1 | 0 | 0 | 0 | 0 | 0 | 0 |
| 8 | 0 | 1 | 0 | 1 | 0 | 0 | 0 | 0 | 0 | 0 |
| 9 | 0 | 1 | 0 | 1 | 0 | 0 | 0 | 0 | 0 | 0 |
| 10 | 0 | 0 | 1 | 1 | 0 | 0 | 0 | 0 | 0 | 0 |
| 11 | 0 | 1 | 1 | 1 | 0 | 0 | 0 | 0 | 0 | 0 |
| 12 | 0 | 1 | 1 | 1 | 0 | 0 | 0 | 0 | 0 | 0 |
| 13 | 0 | 1 | 0 | 0 | 1 | 0 | 0 | 0 | 0 | 0 |
| 14 | 0 | 1 | 0 | 0 | 1 | 0 | 0 | 0 | 0 | 0 |
| 15 | 0 | 0 | 1 | 0 | 1 | 0 | 0 | 0 | 0 | 0 |
| 16 | 0 | 1 | 1 | 0 | 1 | 0 | 0 | 0 | 0 | 0 |
| 17 | 0 | 1 | 1 | 0 | 1 | 0 | 0 | 0 | 0 | 0 |
| 18 | 0 | 0 | 0 | 1 | 1 | 0 | 0 | 0 | 0 | 0 |
| 19 | 0 | 1 | 0 | 1 | 1 | 0 | 0 | 0 | 0 | 0 |
| 20 | 0 | 1 | 0 | 1 | 1 | 0 | 0 | 0 | 0 | 0 |
| 21 | 0 | 0 | 1 | 1 | 1 | 0 | 0 | 0 | 0 | 0 |
| 22 | 0 | 1 | 1 | 1 | 1 | 0 | 0 | 0 | 0 | 0 |
| 23 | 0 | 1 | 1 | 1 | 1 | 0 | 0 | 0 | 0 | 0 |
| 24 | 0 | 1 | 1 | 0 | 0 | 1 | 0 | 0 | 0 | 0 |
| 246 | 0 | 1 | 0 | 0 | 1 | 1 | 1 | 1 | 1 | 1 |
| 247 | 0 | 0 | 1 | 0 | 1 | 1 | 1 | 1 | 1 | 1 |
| 248 | 0 | 1 | 1 | 0 | 1 | 1 | 1 | 1 | 1 | 1 |
| 249 | 0 | 1 | 1 | 0 | 1 | 1 | 1 | 1 | 1 | 1 |
| 250 | 0 | 0 | 0 | 1 | 1 | 1 | 1 | 1 | 1 | 1 |
| 251 | 0 | 1 | 0 | 1 | 1 | 1 | 1 | 1 | 1 | 1 |
| 252 | 0 | 1 | 0 | 1 | 1 | 1 | 1 | 1 | 1 | 1 |
| 253 | 0 | 0 | 1 | 1 | 1 | 1 | 1 | 1 | 1 | 1 |
| 254 | 0 | 1 | 1 | 1 | 1 | 1 | 1 | 1 | 1 | 1 |
| 255 | 0 | 1 | 1 | 1 | 1 | 1 | 1 | 1 | 1 | 1 |

FIG. 5C

| Image signal | 1SF (1) | 2SF (2) | 3SF (3) | 4SF (6) | 5SF (11) | 6SF (18) | 7SF (30) | 8SF (44) | 9SF (60) | 10SF (80) |
|---|---|---|---|---|---|---|---|---|---|---|
| 0 | 0 | 0 | 0 | 0 | 0 | 0 | 0 | 0 | 0 | 0 |
| 1 | 0 | 0 | 0 | 0 | 0 | 0 | 0 | 0 | 0 | 0 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 1 | 0 | 0 | 0 | 0 | 0 | 0 | 0 |
| 5 | 0 | 0 | 1 | 0 | 0 | 0 | 0 | 0 | 0 | 0 |
| 6 | 0 | 0 | 1 | 0 | 0 | 0 | 0 | 0 | 0 | 0 |
| 7 | 0 | 0 | 0 | 1 | 0 | 0 | 0 | 0 | 0 | 0 |
| 8 | 0 | 0 | 0 | 1 | 0 | 0 | 0 | 0 | 0 | 0 |
| 9 | 0 | 0 | 0 | 1 | 0 | 0 | 0 | 0 | 0 | 0 |
| 10 | 0 | 0 | 1 | 1 | 0 | 0 | 0 | 0 | 0 | 0 |
| 11 | 0 | 0 | 1 | 1 | 0 | 0 | 0 | 0 | 0 | 0 |
| 12 | 0 | 0 | 1 | 1 | 0 | 0 | 0 | 0 | 0 | 0 |
| 13 | 0 | 0 | 0 | 0 | 1 | 0 | 0 | 0 | 0 | 0 |
| 14 | 0 | 0 | 0 | 0 | 1 | 0 | 0 | 0 | 0 | 0 |
| 15 | 0 | 0 | 1 | 0 | 1 | 0 | 0 | 0 | 0 | 0 |
| 16 | 0 | 0 | 1 | 0 | 1 | 0 | 0 | 0 | 0 | 0 |
| 17 | 0 | 0 | 1 | 0 | 1 | 0 | 0 | 0 | 0 | 0 |
| 18 | 0 | 0 | 0 | 1 | 1 | 0 | 0 | 0 | 0 | 0 |
| 19 | 0 | 0 | 0 | 1 | 1 | 0 | 0 | 0 | 0 | 0 |
| 20 | 0 | 0 | 0 | 1 | 1 | 0 | 0 | 0 | 0 | 0 |
| 21 | 0 | 0 | 1 | 1 | 1 | 0 | 0 | 0 | 0 | 0 |
| 22 | 0 | 0 | 1 | 1 | 1 | 0 | 0 | 0 | 0 | 0 |
| 23 | 0 | 0 | 1 | 1 | 1 | 0 | 0 | 0 | 0 | 0 |
| 24 | 0 | 0 | 1 | 0 | 0 | 1 | 0 | 0 | 0 | 0 |
| 245 | 0 | 0 | 0 | 0 | 1 | 1 | 1 | 1 | 1 | 1 |
| 246 | 0 | 0 | 0 | 0 | 1 | 1 | 1 | 1 | 1 | 1 |
| 247 | 0 | 0 | 1 | 0 | 1 | 1 | 1 | 1 | 1 | 1 |
| 248 | 0 | 0 | 1 | 0 | 1 | 1 | 1 | 1 | 1 | 1 |
| 249 | 0 | 0 | 1 | 0 | 1 | 1 | 1 | 1 | 1 | 1 |
| 250 | 0 | 0 | 0 | 1 | 1 | 1 | 1 | 1 | 1 | 1 |
| 251 | 0 | 0 | 0 | 1 | 1 | 1 | 1 | 1 | 1 | 1 |
| 252 | 0 | 0 | 0 | 1 | 1 | 1 | 1 | 1 | 1 | 1 |
| 253 | 0 | 0 | 1 | 1 | 1 | 1 | 1 | 1 | 1 | 1 |
| 254 | 0 | 0 | 1 | 1 | 1 | 1 | 1 | 1 | 1 | 1 |
| 255 | 0 | 0 | 1 | 1 | 1 | 1 | 1 | 1 | 1 | 1 |

PLASMA DISPLAY DEVICE

This application is a U.S. national phase application of PCT international application PCT/JP2008/050229.

TECHNICAL FIELD

The present invention relates to a plasma display device for use in a wall-mounted television or a large monitor.

BACKGROUND ART

In a plasma display panel (hereinafter abbreviated as "panel") representative of an image display device having a large number of pixels arranged in a plane shape, a large number of discharge cells are formed as the pixels between the front plate and the rear plate faced to each other. For the front plate, a plurality of display electrode pairs, each made of a scan electrode and a sustain electrode, are formed on a front glass substrate in parallel with each other. A dielectric layer and a protective layer are formed to cover these display electrode pairs. For the rear plate, a plurality of parallel data electrodes are formed on a rear glass substrate and a dielectric layer is formed over the data electrodes to cover them. Further, a plurality of barrier ribs are formed on the dielectric layer in parallel with the data electrodes. Phosphor layers are formed over the surface of the dielectric layer and the side faces of the barrier ribs. The front plate and the rear plate are faced to each other and sealed together so that the display electrode pairs are intersected with the data electrodes. A discharge gas is charged into the inside discharge space formed between the plates. Discharge cells are formed in portions where the display electrode pairs are faced to the data electrodes. For a panel structured as above, gas discharge generates ultraviolet light in each discharge cell. This ultraviolet light excites the red (R), green (G), and blue (G) phosphors so that they emit light for color display.

A subfield method is used as the method of driving a panel. In this method, one field period is divided into a plurality of subfields (each hereinafter also abbreviated as "SF") and the respective discharge cells are lit or unlit in each SF to display an image. Each SF has an initializing period, an address period, and a sustain period. In the initializing period, initializing discharge is caused in the respective discharge cells to form wall charge necessary for the succeeding address operation. In the address period, a scan pulse voltage is sequentially applied to the scan electrodes and an address pulse voltage corresponding to the signals of an image to be displayed is applied to the data electrodes to cause selective address discharge between the scan electrodes and the data electrodes. Thus, wall charge is selectively formed. In the succeeding sustain period, a sustain pulse voltage is applied between the scan electrodes and the sustain electrodes at a predetermined number of times corresponding to the display luminance to be provided. Thus, discharge for lighting is caused selectively in the discharge cells in which wall charge has been formed by the address discharge. The ratio of display luminance between the respective SFs is referred to as "brightness weight".

In order to drive the panel, a plasma display device includes a scan electrode driver circuit for driving the scan electrodes, a sustain electrode driver circuit for driving the sustain electrodes, and a data electrode driver circuit for driving the data electrodes. Each of these electrode drivers applies a necessary drive voltage waveform to the corresponding electrodes. As seen from the side of the data electrode driver circuit, each data electrode is a capacitive load that has a resultant capacitance of the data electrode, the adjacent data electrodes, and the corresponding scan electrodes and sustain electrodes. Thus, in order to apply the drive voltage waveform to each data electrode, the plasma display device needs to charge and discharge this capacitance. The power consumption of the data electrode driver circuit is not only due to the discharge caused by the address discharge. Rather, the power consumption caused by charging and discharging the capacitance of these data electrodes constitutes a larger proportion. This charge/discharge current depends greatly on the signals of an image to be displayed. For example, when no address pulse voltage is applied to all the data electrodes, the charge/discharge current is 0 and thus the power consumption is at minimum. Similarly, when the address pulse voltage is applied to all the data electrodes, the charge/discharge current is 0 and thus the power consumption is small. However, when the address pulse voltage is applied to the data electrodes at random, the charge/discharge current and thus the power consumption are large.

As described above, the power consumption of the data electrode driver circuit varies greatly according to the image signal. For this reason, the power supply for data electrodes that supplies power to the data electrode driver circuit has been designed to have sufficiently large power supply capacity so that normal address operation can be performed even when the power consumption of the data electrode driver circuit is at maximum. However, as the size and definition of the panel is increasing, the maximum power consumption becomes far larger than the power consumed when a normal image is displayed. It is uneconomical to design the power supply for data electrodes so that necessary power can be supplied even in such a case.

To address this problem, a method of reducing the power consumption is disclosed (for example, see Patent Document 1). In this method, the power consumption of the data electrode driver circuit is estimated according to the signals of an image to be displayed. When the estimated value is equal to or larger than a predetermined value, the address operation in the SFs having smaller brightness weights is stopped to limit gradations so that the power consumption is reduced. Another method of reducing the power consumption is also disclosed (for example, see Patent Document 2). In this method, the power consumption of the data electrode driver circuit is actually detected, and the gradations are limited at large power consumption. Another method of decreasing the temperature is disclosed (for example, see Patent Document 3). In this method, the temperature of the data electrode driver circuit is estimated according to an image data in which image signals are correlated to SFs. When the estimated temperature is high, the image signals are converted to decrease the temperature of the data electrode driver circuit.

However, in the methods of limiting gradations according to the power consumption in the data electrode driver circuit, as disclosed in Patent Document 1 and Patent Document 2, for example, a phenomenon of repeating increases and decreases in power consumption in a short cycle is more likely to occur. For example, in a structure having a protection circuit added to the data electrode driver circuit, the protection circuit also makes frequent protecting operation. This operation can hinder stable display operation by pausing image display for protection or the like. On the other hand, in the method of limiting gradations according to the temperature in the data electrode driver circuit as disclosed in Patent Document 3, frequent protecting operation of the protective circuit can be inhibited; however, a prompt response to a rapid increase in power consumption or the like cannot be made. Further, repeated increases and decreases in power consumption and temperature cause repetition between limitation and non limitation of gradations. This repetition between gradation limitation and non limitation causes flickers in the display image, thus degrading the image.

[Patent Document 1] Japanese Patent Unexamined Publication No. 2000-66638

[Patent Document 2] Japanese Patent Unexamined Publication No. 2003-271094

[Patent Document 3] Japanese Patent Unexamined Publication No. 2002-149109

SUMMARY OF THE INVENTION

A plasma display device includes a plasma display panel that has discharge cells each formed at an intersection between a display electrode pair and a data electrode. One field period of an image signal is divided into a plurality of subfields. The plasma display device displays an image by causing the discharge cell to be lit or unlit in each of the subfields. The plasma display device includes the following elements: an image signal conversion circuit for converting an image signal into an image data causing the discharge cell to be lit or unlit in each of the subfields; a data electrode driver circuit for driving the data electrode according to the image data; a power calculator for calculating a power consumption of the data electrode driver circuit according to the image data; and a temperature calculator for calculating a temperature of the data electrode driver circuit according to the image data. At least when the calculated power consumption exceeds a predetermined power threshold value, or when the calculated temperature exceeds a predetermined temperature threshold value, the image signal conversion circuit converts the image signal into an image data decreasing the power consumption of the data electrode driver circuit.

With this structure, even when an image signal increasing the power consumption of the data electrode driver circuit is supplied, the plasma display device is capable of promptly responding to a rapid increase in the power consumption or the like, and making a stable operation to display images without causing malfunction of the data electrode driver circuit.

In the plasma display device, the image signal conversion circuit has a first temperature threshold value, and a second temperature threshold value smaller than the first temperature threshold value, as the predetermined temperature threshold values. At least when the calculated power consumption exceeds the predetermined power threshold value, or when the calculated temperature exceeds the first temperature threshold value, the plasma display device converts the image signal into an image data decreasing the power consumption of the data electrode driver circuit. The plasma display device may be structured to convert the image signal into an image data increasing the power consumption of the data electrode driver circuit, at least when the calculated power consumption is equal to or smaller than the predetermined power threshold value, or when the calculated temperature is equal to or smaller than the second temperature threshold value.

In the plasma display device, the image signal conversion circuit has a first power threshold value, and a second power threshold value smaller than the first power threshold value, as the predetermined power threshold values. At least when the calculated power consumption exceeds the first power threshold value, or when the calculated temperature exceeds the predetermined temperature threshold value, the plasma display device converts the image signal into an image data decreasing the power consumption of the data electrode driver circuit. The plasma display device may be structured to convert the image signal into an image data increasing the power consumption of the data electrode driver circuit, at least when the calculated power consumption is equal to or smaller than the second power threshold value, or when the calculated temperature is equal to or smaller than the predetermined temperature threshold value.

With this structure, even when an image signal increasing the power consumption of the data electrode driver circuit is supplied, the plasma display device is capable of promptly responding to a rapid increase in the power consumption or the like, inhibiting flickers, and making a stable operation to display images without causing malfunction of the data electrode driver circuit.

In the plasma display device, the data electrode driver circuit includes a plurality of drivers corresponding to the data electrodes of the plasma display panel divided into blocks. The plasma display device may be structured so that the power calculator calculates the total power consumption of the plurality of drivers, and the temperature calculator calculates the highest temperature of the plurality of drivers.

With this structure, a prompt response to a rapid increase in the power consumption or the like can be made, according to the comparison between the calculated total power consumption of the respective drivers and the predetermined power threshold value. According to comparison between the highest temperature of the drivers and the predetermined temperature threshold value, the temperature increase in the respective drivers can be inhibited on the basis of the driver having the largest temperature increase, and all the drivers can be protected from problems caused by the temperature increase.

The plasma display device may be structured so that the image signal conversion circuit reduces the power consumption of the data electrode driver circuit in at least one subfield.

With this structure, even without changing the coding table, only stopping the address operation in a corresponding subfield can reduce the power consumption of the data electrode driver circuit.

BRIEF DESCRIPTION OF THE DRAWINGS

FIG. 5A is a table showing an example of the relation between image signals and image data in accordance with the first exemplary embodiment of the present invention.

FIG. 5B is another example of the relation between image signals and image data, i.e. a table showing a coding in which no address operation is to be performed in the first subfield, in accordance with the first exemplary embodiment of the present invention.

FIG. 5C is still another example of the relation between image signals and image data, i.e. a table showing a coding in which no address operation is to be performed in the first and second subfields, in accordance with the first exemplary embodiment of the present invention.

REFERENCE MARKS IN THE DRAWINGS

Figure 1:
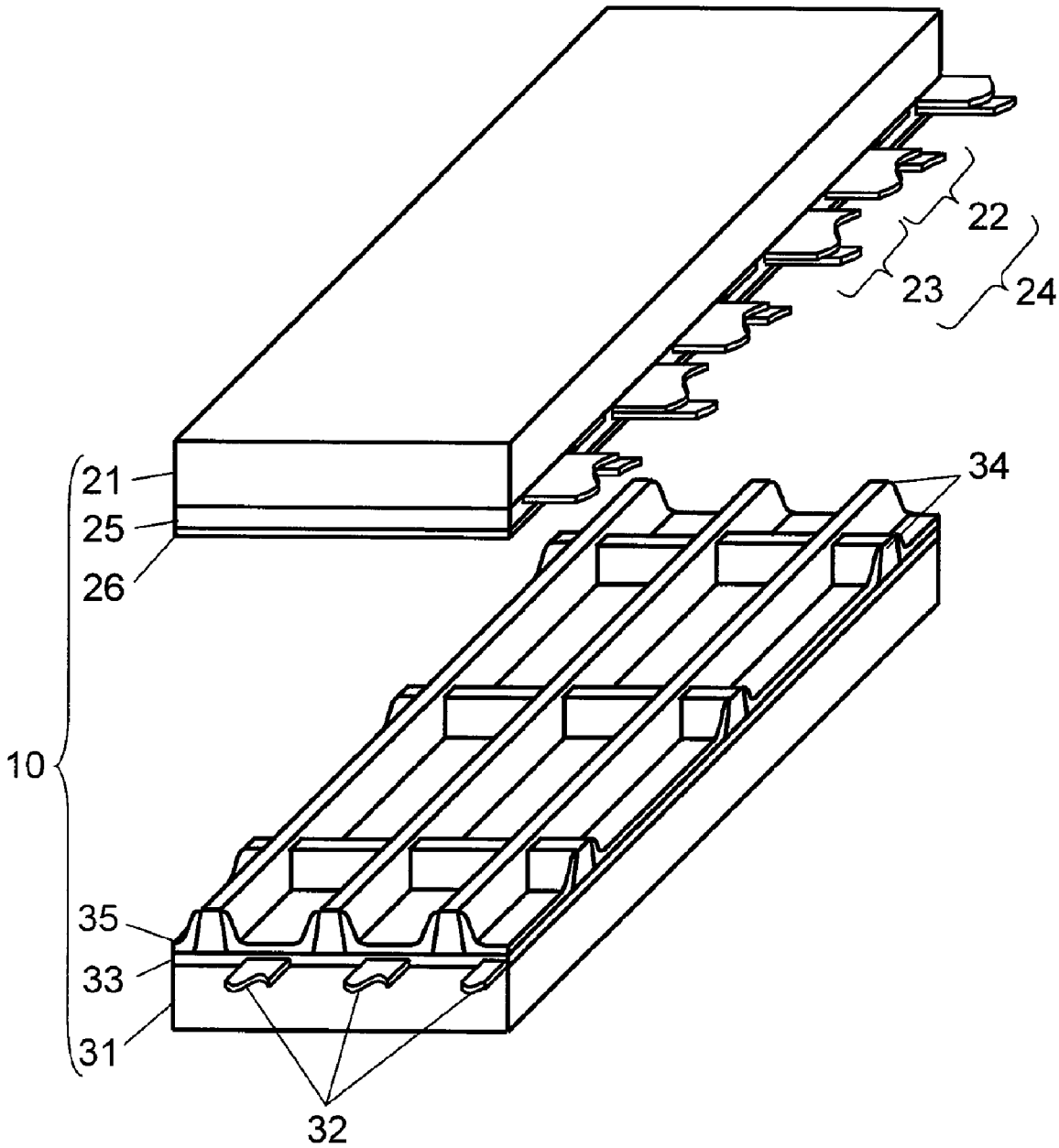
FIG. 1 is an exploded perspective view illustrating an essential part of a panel in accordance with a first exemplary embodiment of the present invention.

10 Panel
21 Front substrate
22 Scan electrode
23 Sustain electrode
24 Display electrode pair
25, 33 Dielectric layer
26 Protective layer
31 Rear substrate
32 Data electrode
34 Barrier rib
35 Phosphor layer
40, 400 Image signal conversion circuit
41 First image converter
42 Second image converter
43, 46 Conversion control data generator
44, 45, 47, 48 Number of target subfields determination circuit
52 Data electrode driver circuit
53 Scan electrode driver circuit
54 Sustain electrode driver circuit
55 Timing generation circuit
60 Data electrode load calculation circuit
61 Temperature calculation circuit (temperature calculator)
62 Power calculation circuit (power calculator)
63 Temperature change detection circuit
64 Power change detection circuit
433, 612 Maximum value detector
521 Drive IC (driver)
601 Load calculation circuit
611 Accumulator
621 Adder

DETAILED DESCRIPTION OF PREFERRED EMBODIMENTS

Hereinafter, a description is provided of plasma display devices in accordance with exemplary embodiments of the present invention, with reference to the accompanying drawings.

First Exemplary Embodiment

FIG. 1 is an exploded perspective view illustrating an essential part of panel 10 in accordance with the first exemplary embodiment of the present invention. In panel 10, front substrate 21 and rear substrate 31 both made of a glass are faced to each other so that a discharge space is formed therebetween. A plurality of scan electrodes 22 and sustain electrodes 23 constituting display electrode pairs 24 are formed on front substrate 21 in parallel with each other. Dielectric layer 25 is formed to cover scan electrodes 22 and sustain electrodes 23. Protective layer 26 is formed over dielectric layer 25. A plurality of data electrodes 32 are formed on rear substrate 31. Dielectric layer 33 is formed to cover data electrodes 32. On dielectric layer 33, barrier ribs 34 are provided in a double cross shape. Further, over the surface of dielectric layer 33 and side faces of barrier ribs 34, phosphor layers 35 are provided. Front substrate 21 and rear substrate 31 are faced to each other in the direction in which scan electrodes 22 and sustain electrodes 23 are intersected with data electrodes 32. In the discharge space formed therebetween, a mixed gas of neon and xenon, for example, is charged as a discharge gas. The structure of panel 10 is not limited to the above, and may include stripe-shaped barrier ribs.

Figure 2:
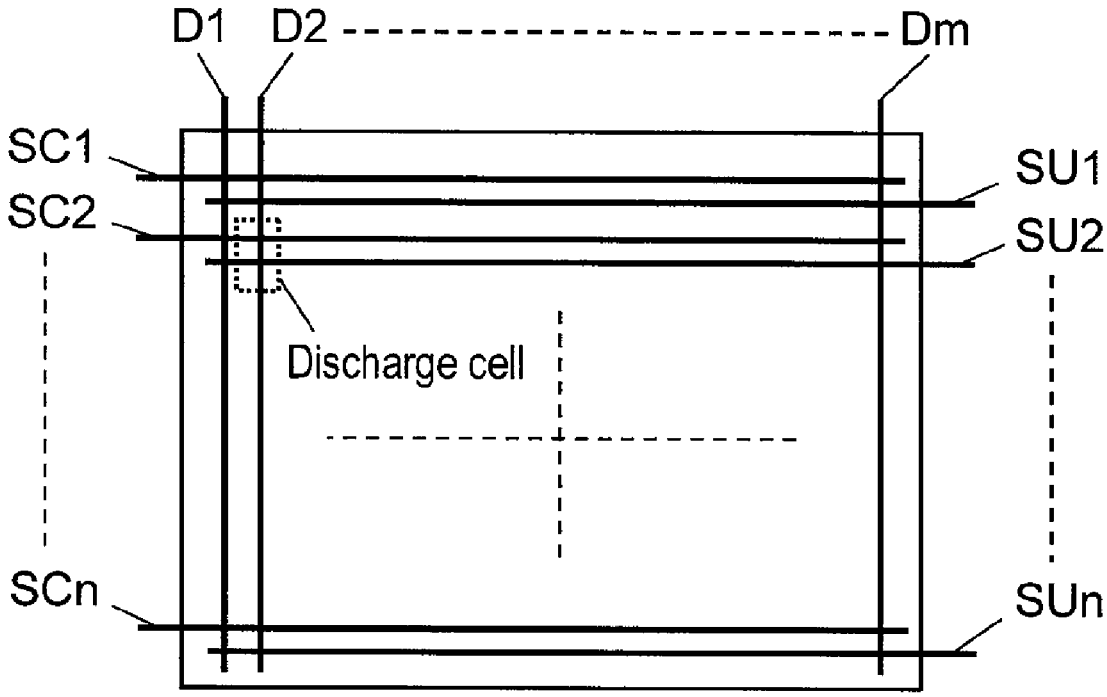
FIG. 2 is a diagram illustrating an array of electrodes of the panel.

FIG. 2 is a diagram showing an array of electrodes of panel 10 in accordance with the first exemplary embodiment of the present invention. The panel includes an array of n scan electrodes SC1 to SCn (scan electrodes 22 in FIG. 1) and n sustain electrodes SU1 to SUn (sustain electrodes 23 in FIG. 1) both long in the row direction, and an array of m data electrodes D1 to Dm (data electrodes 32 in FIG. 1) long in the column direction. A discharge cell is formed in a portion where a pair of scan electrode SCi and sustain electrode SUi (i=1 to n) is intersected with one data electrode Dj (j=1 to m). Thus, m×n discharge cells are formed in the discharge space.

Next, a description is provided of driving voltage waveforms for driving panel 10. In this exemplary embodiment, a description is provided of an example in which one field is divided into 10 subfields (SFs) (i.e. the first SF, and second SF to tenth SF), and the respective SFs have different brightness weights (e.g. 1, 2, 3, 6, 11, 18, 30, 44, 60, and 80). Thus, in this exemplary embodiment, the brightness weight is set larger in the SF disposed in the later position. However, in the present invention, the number of SFs and the brightness weights of the respective SFs are not limited to the above values.

Figure 3:
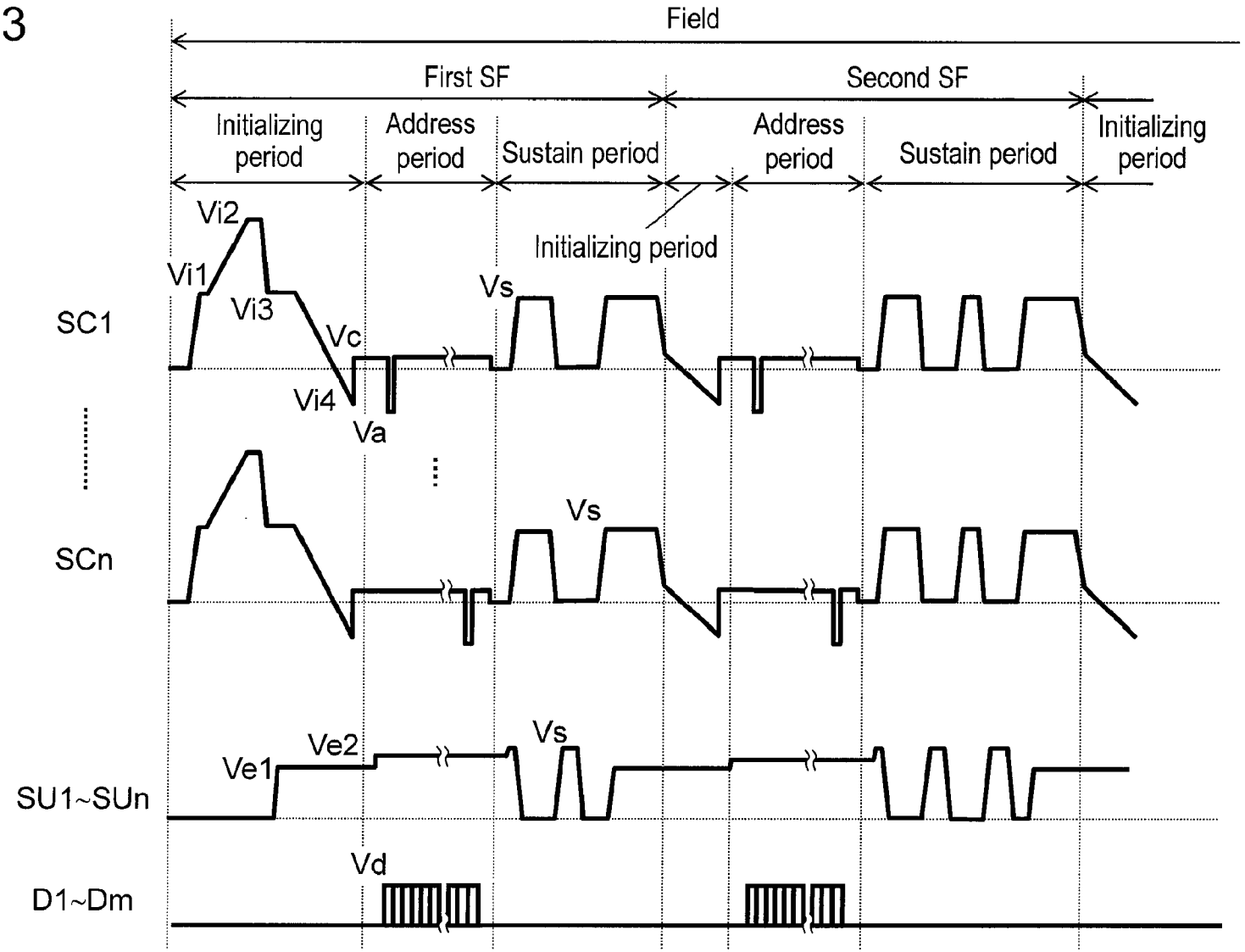
FIG. 3 is a diagram showing driving voltage waveforms to be applied to the respective electrodes of the panel.

FIG. 3 is a diagram showing driving voltage waveforms to be applied to the respective electrodes of panel 10 in the first exemplary embodiment of the present invention.

In the first half of the initializing period, data electrodes D1 to Dm and sustain electrodes SU1 to SUn are kept at 0 V. Applied to scan electrodes SC1 to SCn is a ramp voltage that gently increases from voltage Vi1 of a breakdown voltage or lower to voltage Vi2 exceeding the breakdown voltage. Then, a weak initializing discharge occurs in all the discharge cells. Wall voltage accumulates on scan electrodes SC1 to SCn, sustain electrodes SU1 to SUn, and data electrodes D1 to Dm. Now, the wall voltage on the electrodes refers to the voltage generated by the wall charge accumulated on the dielectric layers, phosphor layers, and the like covering the electrodes.

In the second half of the initializing period, sustain electrodes SU1 to SUn are kept at voltage Ve1. Applied to scan electrodes SC1 to SCn is a ramp voltage that gently decreases from voltage Vi3 to voltage Vi4. Then, weak initializing discharge occurs again in all the discharge cells. This weak discharge adjusts the wall voltage on scan electrodes SC1 to SCn, sustain electrodes SU1 to SUn, and data electrodes D1 to Dm to values appropriate for the address operation.

In some of the SFs constituting one field, the first half of the initializing period can be omitted. In this case, a selective initializing operation is performed on the discharge cells subjected to sustain discharge in the preceding SF. FIG. 3 shows driving voltage waveforms that causes an initializing operation having the first and second halves in the initializing period of the first SF and causes an initializing operation only having the second half in the initializing period of the second SF and thereafter.

In the address period, voltage Ve2 is applied to sustain electrodes SU1 to SUn. Address pulse voltage Vd is applied to data electrode Dk (k=1 to m) of the discharge cell to be lit in the first row, among data electrodes D1 to Dm. Scan pulse voltage Va is applied to scan electrode SC1 in the first row. Then, address discharge occurs between data electrodes Dk and scan electrode SC1, and between sustain electrode SU1 and scan electrode SC1. In this discharge cell, positive wall voltage accumulates on scan electrode SC1 and negative wall voltage accumulates on sustain electrode SU1. In this manner, an address operation is performed to cause address discharge in the discharge cells to be lit in the first row, and to accumulate wall voltage on the corresponding electrodes. On the other hand, no address discharge occurs at the intersections between data electrodes Dh (h≠k) subjected to no address pulse voltage Vd and scan electrode SC1. The above address operation is performed sequentially on the discharge cells up to the n-th row and the address period is completed.

The data electrode driver circuit to be described later drives each of data electrodes D1 to Dm as above. As seen from the side of the data electrode driver circuit, each data electrode Dj is a capacitive load. Thus, in each address period, this capacitance needs to be charged and discharged every time the voltage applied to each data electrode is changed from earth potential 0 V to address pulse voltage Vd, or from address pulse voltage Vd to earth potential 0 V. Charging/discharging at a larger number of times causes the data electrode driver circuit to consume more power.

In the succeeding sustain period, sustain electrodes SU1 to SUn are returned to 0 V, and sustain pulse voltage Vs is applied to scan electrodes SC1 to SCn. At this time, in the discharge cells having generated address discharge, the voltage between scan electrode SCi and sustain electrode SUi is the addition of sustain pulse voltage Vs and the wall voltage on scan electrode SCi and the wall voltage on sustain electrode SUi, thereby exceeding the breakdown voltage. Thus, sustain discharge occurs between scan electrode SCi and sustain electrode SUi, generating light. At this time, negative wall voltage accumulates on scan electrode SCi, and positive wall voltage accumulates on sustain electrodes SUi. Next, scan electrodes SC1 to SCn are returned to 0 V, and sustain pulse voltage Vs is applied to sustain electrodes SU1 to SUn. Then, in the discharge cell having generated sustain discharge, the voltage between sustain electrode SUi and scan electrode SCi exceeds the breakdown voltage, thereby causing sustain discharge between sustain electrode SUi and scan electrode SCi again. As a result, negative wall voltage accumulates on sustain electrode SUi, and positive wall voltage on scan electrode SCi.

Similarly, a number of sustain pulses proportional to the brightness weight are applied to scan electrodes SC1 to SCn and sustain electrodes SU1 to SUn to cause continuous sustain discharge in the discharge cells having generated address discharge in the address period. In the discharge cells having generated no address discharge in the address period, sustain discharge does not occur and the wall voltage at the completion of the initializing period is maintained. Thus, the sustain operation in the sustain period is completed.

In the succeeding second to tenth SFs, the operations in the initializing period and address period are the same as those in the first SF. In each sustain period, the same sustain operation as that in the sustain period of the first SF is performed except for the number of sustain pulses. In this manner, the respective discharge cells are controlled for each of the SFs so that the cells are lit or unlit. Thus, an image is displayed by the combination of the brightness weights in the respective SFs.

Figure 4:
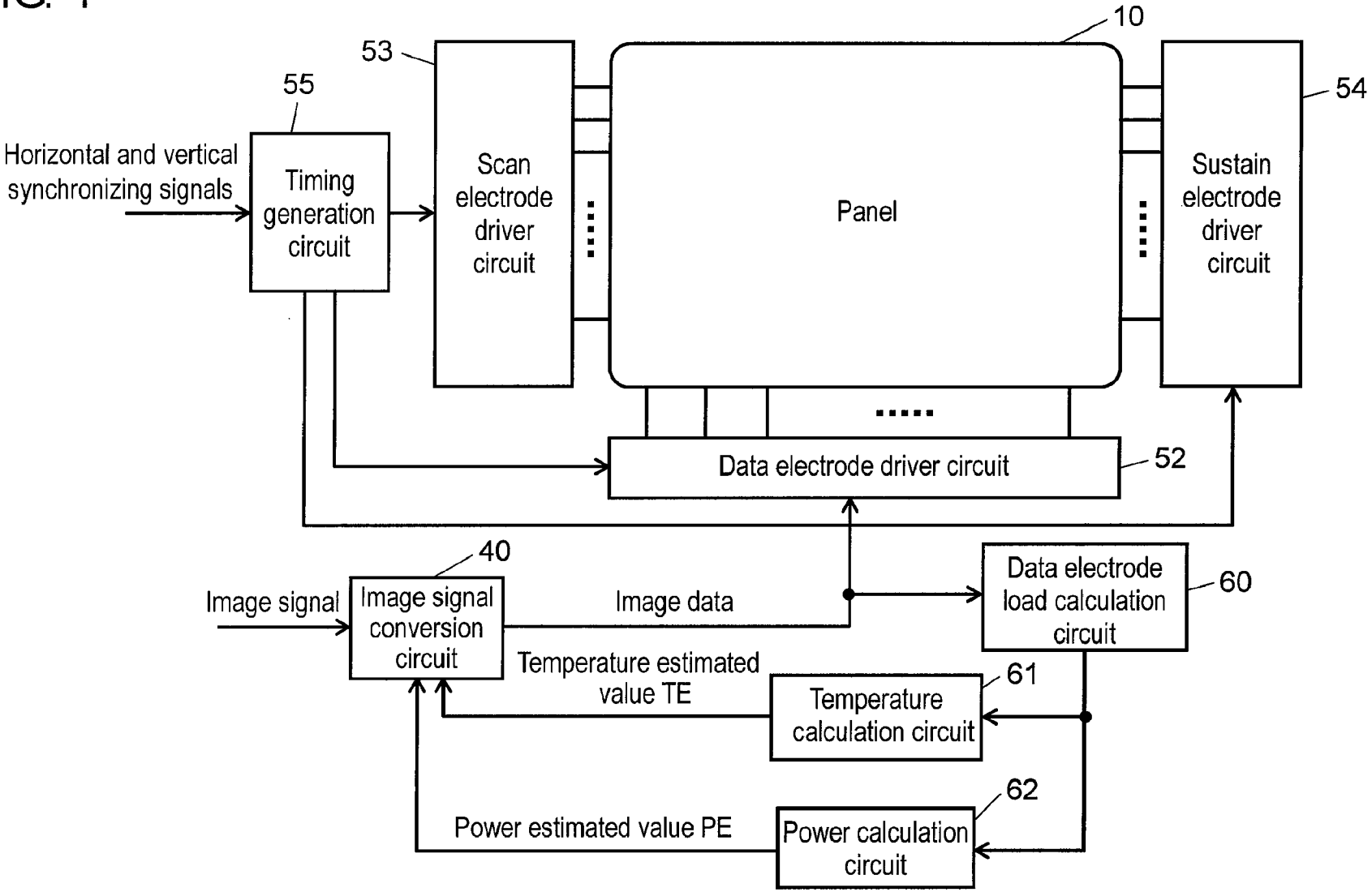
FIG. 4 is a circuit block diagram of a plasma display device in accordance with the first exemplary embodiment of the present invention.

FIG. 4 is a circuit block diagram of a plasma display device in accordance with the first exemplary embodiment. The plasma display device of this exemplary embodiment includes the following elements: panel 10; image signal conversion circuit 40; data electrode driver circuit 52; scan electrode driver circuit 53; sustain electrode driver circuit 54; timing generation circuit 55; data electrode load calculation circuit 60; temperature calculation circuit 61 as a temperature calculator; power calculation circuit 62 as a power calculator;

and a power supply circuit (not shown) for supplying power necessary for the respective circuit blocks.

Timing generation circuit 55 generates various kinds of timing signals for controlling the operation of each circuit block, according to a horizontal synchronizing signal and a vertical synchronizing signal, and supplies the timing signals to the corresponding circuit blocks. Scan electrode driver circuit 53 applies the drive voltage waveforms of FIG. 3 to respective scan electrodes SC1 to SCn, according to the various timing signals. Sustain electrode driver circuit 54 applies the drive voltage waveform of FIG. 3 to sustain electrodes SU1 to SUn, according to the various timing signals.

Image signal conversion circuit 40 converts a supplied image signal into an image data showing whether to light the cells or not for each SF. For ease of explanation, assume that the image signal is a primary color signal showing red, green, or blue, and each primary color signal is a digital signal having a minimum value of 0 and a maximum value of 255.

FIGS. 5A, 5B, and 5C are tables each showing the relation between image signals and image data of the first exemplary embodiment of the present invention. Hereinafter, the relation showing in which SF the supplied image signal causes the discharge cells to be lit is abbreviated as "coding". In FIGS. 5A, 5B, and 5C, the numerical values shown in the leftmost column are values corresponding to the brightness of the image signals. The columns on the right side thereof show whether to light the discharge cells or not in the respective SFs, when the brightness of the corresponding image signals is displayed. "0" shows no light emission, and "1" shows light emission. As shown in FIG. 5A, for example, when a primary color signal of 1 is supplied, the discharge cells are lit only in the first SF having a brightness weight of 1 so that a brightness of 1 is displayed. When a primary color signal of 7 is supplied, the discharge cells are lit in the first SF having a brightness weight of 1 and in the fourth SF having a brightness weight of 6 so that a brightness of 7 is displayed. When a primary color signal of 14 is supplied, the discharge cells are lit in the first SF and the second SF having brightness weights of 1 and 2, respectively, and in the fifth SF having a brightness weight of 11 so that a brightness of 14 is displayed. When a brightness of 3 is displayed, the following two methods can be used. The discharge cells are lit in the first SF and the second SF, or lit in the third SF only. When a plurality of kinds of coding can be used, a coding in which the discharge cells are lit in the SF having a smaller brightness weight is selected. In other words, for displaying a brightness of 3, the discharge cells are lit in the first SF and the second SF as shown in FIG. 5A. The circuit for converting image signals into image data as described above can be implemented by a data conversion table using a ROM or the like.

Further, image signal conversion circuit 40 changes the coding according to the conversion control data to be described later. The conversion control data is a data showing at least the case where the power consumption of data electrode driver circuit 52 is larger than a predetermined power threshold value or the case where the temperature thereof is larger than a predetermined temperature threshold value. According to this conversion control data, image signal conversion circuit 40 converts an image signal into an image data that decreases the power consumption of data electrode driver circuit 52. Specifically, in this exemplary embodiment, when image signal conversion circuit 40 substantially determines that at least one of the power consumption and temperature of data electrode driver circuit 52 is increased, the image signal conversion circuit changes the predetermined coding to a coding in which no address operation is performed in a SF having a smaller brightness weight.

FIGS. 5B and 5C show other examples of a coding changed according to the conversion control data of this exemplary embodiment. FIG. 5B shows a coding in which no address operation is performed in the first SF. FIG. 5C shows a coding in which no address operation is performed in the first SF and the second SF. Though not shown, similar kinds of coding include a coding in which no address operation is performed in the first to third SFs, and a coding in which no address operation is performed in the first to fourth SFs. In the coding in which no address operation is performed in the first SF as shown in FIG. 5B, for example, brightness weights of 1, 3, 4, 6, and so on cannot be displayed. However, because no address operation is performed in the first SF, the power consumption for the operation can be reduced. In this manner, an increase in the number of SFs in which no address operation is performed reduces the number of displayable brightness. However, the power consumption for the address operation can be reduced.

The above change of the kinds of coding can be made by switching a plurality of data conversion tables. However, the change can also be made easily by fixing the corresponding bit of image data showing whether to light the discharge cells or not for each SF to 0. The power consumption of the data electrode driver circuit is decreased when address pulse voltage is applied to all the data electrodes, as well as when no address pulse voltage is applied to all the data electrodes as described above For this reason, in place of a coding in which no address operation is performed in some SFs as shown in FIG. 5B and FIG. 5C, image signal conversion circuit 40 may change the predetermined coding to a coding in which address operation is performed in a SF having a smaller brightness weight when the image signal conversion circuit determines that at least one of the power consumption and temperature of data driver circuit 52 is increased. In this case, this structure can also be implemented easily by fixing the corresponding bit of image data showing whether to light the discharge cells or not for each SF to 1. Hereinafter, in the first exemplary embodiments of the present invention, a description is provided of an example of a coding in which no address operation is performed in some SFs as shown in FIG. 5B and FIG. 5C.

Image signal conversion circuit 40 converts an image signal into an image data that causes the discharge cells to be lit or unlit in each of the SF periods. Particularly in this conversion processing, image signal conversion circuit 40 converts the image signal into an image data that decreases the power consumption of data electrode driver circuit 52 at least when the power consumption of data electrode driver circuit 52 is larger than a predetermined power threshold value or when the temperature thereof is larger than a predetermined temperature threshold value. Hereinafter, this conversion processing is detailed.

Image signal conversion circuit 40 supplies the image data thus generated to data electrode driver circuit 52. Data electrode driver circuit 52 converts the image data for each SF into signals corresponding to data electrodes D1 to Dm, and drives respective data electrodes D1 to Dm.

The image data generated by image signal conversion circuit 40 is also supplied to data electrode load calculation circuit 60. Data electrode load calculation circuit 60 calculates the load amount of data electrode driver circuit 52 in each field by computation.

As described above, data electrodes 32 are capacitive loads as seen from data electrode driver circuit 52. Thus, frequent changes in the voltage applied to data electrodes 32 increase the load because the capacitance of data electrodes 32 is charged and discharged. This increased load increases the power consumption of data electrode driver circuit 52. For example, when an address pulse voltage is applied to discharge cells having even-numbered scan electrodes SCp (p=an even number), and no address pulse voltage is applied to discharge cells having odd-numbered scan electrodes SC (p+1), voltage 0 and voltage Vd are alternately applied to the corresponding data electrodes Dj. This operation considerably increases the power consumption. In addition, when voltage 0 and voltage Vd are alternately applied in opposite phase to data electrodes D(j−1) and D(j+1), which are both adjacent to data electrodes Dj the power consumption is further increased.

In contrast, when no address pulse voltage is applied to all the data electrodes 32, the power consumption is minimized. Similarly, when an address pulse voltage is applied to all the data electrodes 32, the power consumption is small. When a normal image is displayed, the power consumption of data electrode driver circuit 52 varies with image signals. For these reasons, for image signals providing an image in a checkered pattern in which the lighting states of the adjacent discharge cells are inverted, the number of changes in address pulse voltage increases, which increases the power consumption of data electrode driver circuit 52.

On the basis of such a relation between the driving states of the respective discharge cells and the power consumption, data electrode load calculation circuit 60 may exclusive-OR the data of the adjacent cells in the horizontal and vertical directions in the image data in each SF to detect changes in address pulse voltage. Further, data electrode load calculation circuit 60 may obtain the total sum of these computation results to detect the number of changes in address pulse voltage. Then, according to the number of changes, the data electrode load calculation circuit may calculate the load amount of data electrode driver circuit 52 estimated per field. Data electrode load calculation circuit 60 informs temperature calculation circuit 61 and power calculation circuit 62 of the load amount thus calculated, as a load value.

Temperature calculation circuit 61 calculates a temperature in data electrode driver circuit 52 by performing further computations on the load values calculated by data electrode load calculation circuit 60. Power calculation circuit 62 calculates a power consumption in data electrode driver circuit 52 by performing further computations on the load values calculated by data electrode load calculation circuit 60. In this manner, temperature calculation circuit 61 calculates the temperature in data electrode driver circuit 52 according to the image data supplied from image signal conversion circuit 40. Power calculation circuit 62 calculates the power consumption in data electrode driver circuit 52 according to the image data supplied from image signal conversion circuit 40.

Temperature calculation circuit 61 informs image signal conversion circuit 40 of the calculated temperature as temperature estimated value TE. Power calculation circuit 62 informs image signal conversion circuit 40 of the calculated power consumption as power estimated value PE.

According to the informed temperature estimated value TE and power estimated value PE, image signal conversion circuit 40 generates a conversion control data for controlling conversion of the image signal, and outputs an image data generated according to a coding based on the conversion control data.

With the above structure, in the plasma display device of this exemplary embodiment, power calculation circuit 62 calculates the power consumption of data electrode driver circuit 52 and temperature calculation circuit 61 calculates the temperature of data electrode driver circuit 52, according to the image data supplied from image signal conversion circuit 40. Further, image signal conversion circuit 40 generates a conversion control data based on the calculated power consumption and temperature. Then, at least when the calculated power consumption of data electrode driver circuit 52 exceeds a predetermined power threshold value, or when the calculated temperature of data electrode driver circuit 52 exceeds a predetermined temperature threshold value, image signal conversion circuit 40 changes the predetermined coding to a coding in which no address operation is performed in a SF having a smaller brightness weight, according to the conversion control data. In other words, image signal conversion circuit 40 operates to convert the image signal into an image data that decreases the power consumption of data electrode driver circuit 52. The plasma display device of this exemplary embodiment controls the power consumption adaptively for the image signals by performing such a feedback processing.

Figure 6:
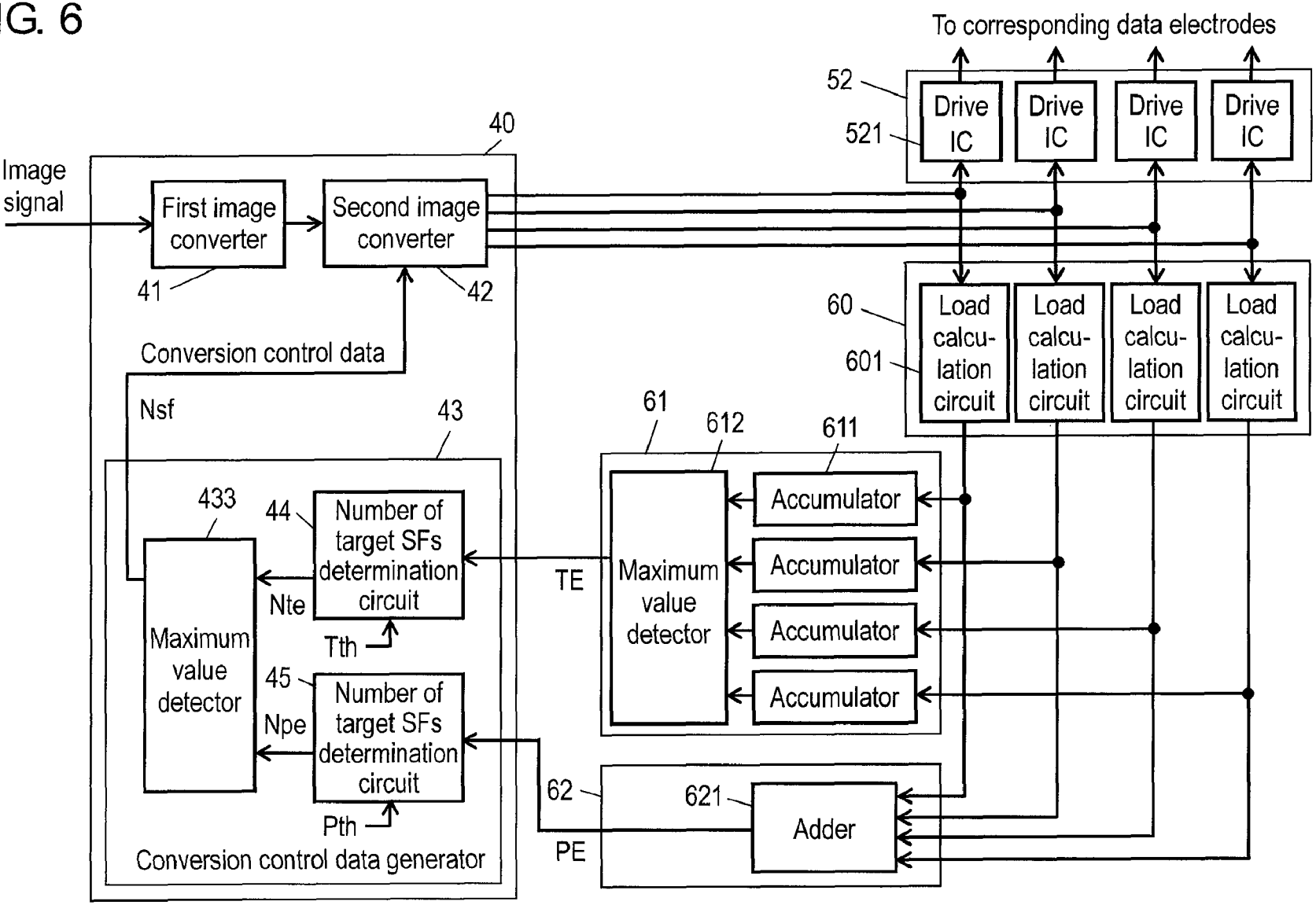
FIG. 6 is a circuit block diagram showing a detailed example of an essential part of a circuit structure for controlling power consumption of the plasma display device in accordance with the first exemplary embodiment of the present invention.

Next, a description is provided of a more detailed structure for adaptively controlling the power consumption in the plasma display device of this exemplary embodiment. FIG. 6 is a circuit block diagram showing a detailed structural example of an essential part of the circuit structure for controlling the power consumption of the plasma display device in accordance with the first exemplary embodiment of the present invention. In this example, data electrode driver circuit 52 is formed of a plurality of integrated circuits working as drivers, i.e. drive ICs. As an example, a description is provided of data electrode driver circuit 52 that includes the plurality of drivers corresponding to data electrodes 32 of panel 10 divided into blocks. Shown in FIG. 6 is an example of a structure in which data electrode driver circuit 52 includes four of such drive ICs 521 and calculates the power consumption and temperature for each drive IC 521.

As shown in FIG. 6, image signal conversion circuit 40 includes first image converter 41, second image converter 42, and conversion control data generator 43. First image converter 41 converts a supplied image signal into an image data showing whether to light the cells or not for each SF, according to a predetermined coding as shown in FIG. 5A. Second image converter 42 converts the image data according to the predetermined coding into an image data according to a coding in which no address operation is performed in a SF having a smaller brightness weight as shown in FIG. 5B or FIG. 5C, for example, on the basis of the conversion control data informed by conversion control data generator 43. Further, second image converter 42 supplies the image data thus generated to each of the plurality of drive ICs 521 connected to corresponding data electrodes 32 of panel 10 divided into blocks. The details of conversion control data generator 43 are described later.

Data electrode load calculation circuit 60 includes a plurality of load calculation circuits 601 for calculating load values corresponding to the load amounts in each field for corresponding drive ICs 521. Each load calculation circuit 601 detects the number of changes in the address pulse voltage applied to the discharge cells in the horizontal and vertical directions in the corresponding block of the image data by the above exclusive-or operation and total sum operation, and outputs the results as a load value for the corresponding one of drive ICs 521.

Temperature calculation circuit 61 includes a plurality of accumulators 611 each for determining the temperature of the corresponding one of drive ICs 521 using the load values informed by load calculation circuit 601, and maximum value detector 612 for detecting and outputting the maximum value of the output values from respective accumulators 611. Each of accumulators 611 calculates a temperature estimated value in corresponding drive IC 521 by performing cumulative operation on the load values corresponding to drive IC 521. In other words, in this exemplary embodiment, on the assumption that the load value calculated in load calculation circuit 601 is proportional to the power consumption of drive IC 521, accumulator 611 determines the temperature by integrating such load values corresponding to the power consumption per unit time. More specifically, accumulator 611 can be implemented by a recursive filter taking heat dissipation into consideration, for example. In other words, the temperature in drive IC 521 can be estimated by a structure in which the heat dissipation is set as coefficient $\alpha$ satisfying $0<\alpha<1$, and for the load value supplied per field, the load value in the current field and the output value in the preceding field multiplied by $\alpha$ are added. Respective accumulators 611 inform maximum value detector 612 of the values of thus determined temperature. Maximum value detector 612 detects the maximum value of the determined values of the temperature informed from respective accumulators 611, and informs image signal conversion circuit 40 of the detected maximum value, as temperature estimated value TE. As shown in the structure of temperature calculation circuit 61, the temperature of each drive IC 521 may be determined to provide the maximum value thereof. In other words, the highest temperature of the plurality of drivers may be calculated. With such a structure, the temperature increase in each drive IC 521 can be inhibited on the basis of drive IC 521 having the largest temperature increase. Thus, even when the plasma display device includes a plurality of drive ICs 521, all the drive ICs 521 can securely be protected from problems caused by temperature increase.

Power calculation circuit 62 includes adder 621 for obtaining the total sum of the load values informed from load calculation circuits 601. In this exemplary embodiment, on the assumption that the load values calculated by load calculation circuits 601 are proportional to the power consumption of drive ICs 521, adder 621 performs such total sum operation on the respective load values. With this operation, power calculation circuit 62 calculates the power consumption of all the drive ICs 521, i.e. the total power consumption of the plurality of drivers. Power calculation circuit 62 informs image signal conversion circuit 40 of the thus obtained total sum of the respective load values, as power estimated value PE.

Temperature estimated value TE from temperature calculation circuit 61 and power estimated value PE from power calculation circuit 62 are informed to conversion control data generator 43 in image signal conversion circuit 40. Conversion control data generator 43 includes number of target SFs determination circuit 44 for determining the number of SFs according to temperature estimated value TE, number of target SFs determination circuit 45 for determining the number of SFs according to power estimated value PE, and maximum value detector 433 for detecting and outputting the maximum value of the output values from number of target SFs determination circuit 44 and number of target SFs determination circuit 45. The number of SFs determined by number of target SFs determination circuit 44 and the number of SFs determined by number of target SFs determination circuit 45 correspond to the numbers of SFs in which no address operation is to be performed. Conversion control data generator 43 stores temperature threshold value Tth showing a predetermined temperature value, and power threshold value Pth showing a predetermined power value. Temperature threshold value Tth is informed to number of target SFs determination circuit 44, and power threshold value Pth is informed to number of target SFs determination circuit 45.

Number of target SFs determination circuit 44 in conversion control data generator 43 determines the number of target SFs based on informed temperature threshold value Tth according to temperature estimated value TE, and outputs the determined number as number of target SFs Nte according to temperature estimated value TE. Specifically, to number of target SFs determination circuit 44, at least one temperature threshold value Tth with respect to temperature estimated value TE is informed. Then, number of target SFs determination circuit 44 compares temperature estimated value TE informed for each field with temperature threshold value Tth, and determines whether temperature estimated value TE has exceeded temperature threshold value Tth showing a predetermined temperature. According to this determination result, number of target SFs determination circuit 44 determines the number of target SFs. An example of determination is as follows. A first temperature threshold value and a second temperature threshold value are provided. When temperature estimated value TE is equal to or smaller than the first temperature threshold value, the number of target SFs Nte is 0. When temperature estimated value TE exceeds the first temperature threshold value, and is equal to or smaller than the second temperature threshold value, number of target SFs Nte is 1. When temperature estimated value TE exceeds the second temperature threshold value, the number of target SFs Nte is 2.

Number of target SFs determination circuit 45 determines the number of target SFs based on informed power threshold value Pth according to power estimated value PE, and outputs the determined number as number of target SFs Npe according to temperature estimated value PE. Specifically, similar to number of target SFs determination circuit 44, at least one power threshold value Pth with respect to power estimated value PE is informed to number of target SFs determination circuit 45. Then, number of target SFs determination circuit 45 compares power estimated value PE informed for each field with power threshold value Pth, and determines whether power estimated value PE has exceeded power threshold value Pth showing a predetermined power. According to this determination result, number of target SFs determination circuit 45 determines the number of target SFs.

Maximum value detector 433 detects the larger value of number of target SFs Nte determined by number of target SFs determination circuit 44 and number of target SFs Npe determined by number of target SFs determination circuit 45, and sets the detected value as number of SFs to be limited Nsf. Maximum value detector 433 informs second image converter 42 of such number of SFs to be limited Nsf as a conversion control data. With this structure, conversion control data generator 43 sets the larger one of number of target SFs Nte based on the temperature and number of target SFs Npe based on the power consumption, as the number of SFs in which no address operation is to be performed from the SF having the smallest brightness weight in order, i.e. number of SFs to be limited Nsf, which is the number of SFs to be limited. The conversion control data generator informs second image converter 42 of the larger number, as the conversion control data showing number of SFs to be limited Nsf.

In this manner, second image converter 42 sets the number of SFs in which no address operation is to be performed from the SF having the smallest brightness weight in order, according to the number of SFs shown in the informed conversion control data, i.e. number of SFs to be limited Nsf. Then, according to the set number of SFs in which no address operation is to be performed, second image converter 42 converts an image data according to a predetermined coding as shown in FIG. 5A into an image data according to a coding as shown in FIG. 5B or FIG. 5C, i.e. an image data that decreases the power consumption of data electrode driver circuit 52. In this manner, image signal conversion circuit 40 changes the image data into an image data that decreases the power consumption of data electrode driver circuit 52 in at least one SF.

As described above, conversion control data generator 43 in image signal conversion circuit 40 determines at least the case where the power consumption of data electrode driver circuit 52 exceeds a predetermined power threshold value or the case where the temperature thereof exceeds a predetermined temperature threshold value, and informs second image converter 42 of generated number of SFs to be limited Nsf, as a conversion control data. Then, according to such a conversion control data, second image converter 42 converts the image data into an image data that decreases the power consumption of data electrode driver circuit 52.

FIGS. 7A, 7B, 7C, and 7D are diagrams showing an example of the operation of generating a conversion control data based on power estimated value PE and temperature estimated value TE in the plasma display device of the first exemplary embodiment of the present invention. Hereinafter, a description is provided of the operation of controlling the power consumption of data electrode driver circuit 52 adaptively for image signals in the structure of FIG. 6, with reference to FIGS. 7A, 7B, 7C, and 7D. A description is provided of an example in which the number of all the SFs is 10 and the number of SFs to be limited is changeable from 1 to 8. In other words, the first to tenth SFs as shown in FIG. 5A are set as SFs, and according to the conversion control data, control is made to change the predetermined coding to those ranging from a coding of FIG. 5B in which no address operation is performed in the first SF having the smallest brightness weight to a coding in which no address operation is performed in the first to the eighth SFs. Specifically in this example, when number of SFs to be limited Nsf is 0 in the conversion control data, all the SFs are subjected to address operation. When number of SFs to be limited Nsf is 1, the first SF is to be limited. Sequentially, number of SFs to be limited Nsf is increased. Then, when number of SFs to be limited Nsf is 8, the first to the eighth SFs are to be limited.

Figure 7A:
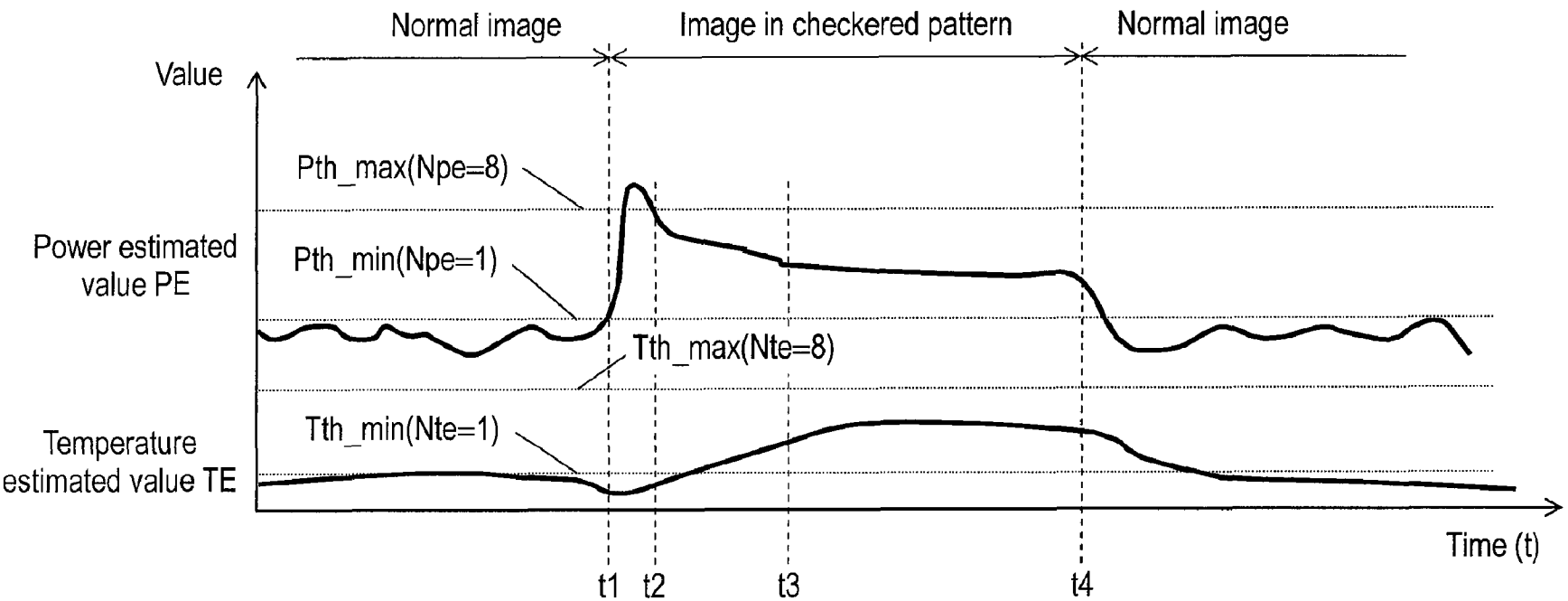
FIG. 7A is a diagram showing an example of the operation of generating a conversion control data in the plasma display device in accordance with the first exemplary embodiment of the present invention.

FIG. 7A shows an example of changes in power estimated value PE and temperature estimated value TE when supplied image signals are switched between normal signals and signals that increase the power consumption of data electrode driver circuit 52 and provide an image in a checkered pattern. FIG. 7A shows a case where normal image signals are supplied until time t1, and image signals for providing an image in a checkered pattern are supplied from time t1 to time t4 and returned to the normal signals after time t4.

FIG. 7A shows temperature maximum threshold value Tth_max and temperature minimum threshold value Tth_min with which number of target SFs determination circuit 44 determines number of target SFs Nte according to temperature estimated value TE, and power maximum threshold value Pth_max and power minimum threshold value Tth_min with which number of target SFs determination circuit 45 determines number of target SFs Npe according to power estimated value PE. In other words, this is an example in which the number of SFs to be limited is 8. Accordingly, eight different temperature threshold values Tth and eight different power threshold values Pth are stored in conversion control data generator 43. According to this number, number of target SFs determination circuit 44 sets 0 as number of target SFs Nte when temperature estimated value TE is equal to or smaller than temperature minimum threshold value Tth_min. When temperature estimated value TE exceeds temperature minimum threshold value Tth_min and is equal to or smaller than the threshold value second to the minimum threshold value, the number of target SFs determination circuit outputs 1 as number of target SFs Nte. Then, number of target SFs determination circuit 44 sequentially increments number of target SFs Nte, corresponding to the respective threshold values. When temperature estimated value TE exceeds temperature maximum threshold value Tth_max, the number of target SFs determination circuit outputs 8 as number of target SFs Nte. Similarly, number of target SFs determination circuit 45 sets 0 as number of target SFs Npe when power estimated value PE is equal to or smaller than power minimum threshold value Pth_min. When power estimated value PE exceeds power minimum threshold value Pth_min and is equal to or smaller than the threshold value second to the minimum power threshold value, the number of target SFs determination circuit outputs 1 as number of target SFs Npe. Then, number of target SFs determination circuit 45 sequentially increments number of target SFs Npe, corresponding to the respective threshold values. When power estimated value PE exceeds power maximum threshold value Pth_max, the number of target SFs determination circuit outputs 8 as number of target SFs Npe.

Figure 7B:
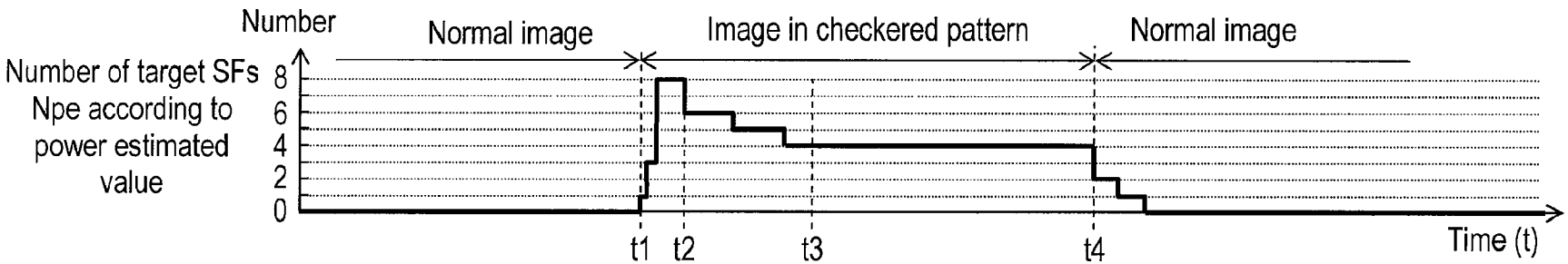
FIG. 7B is a diagram showing the example of the operation of generating the conversion control data and the number of target subfields determined by a number of target subfields determination circuit according to a power estimated value in the plasma display device in accordance with the first exemplary embodiment of the present invention.
Figure 7C:
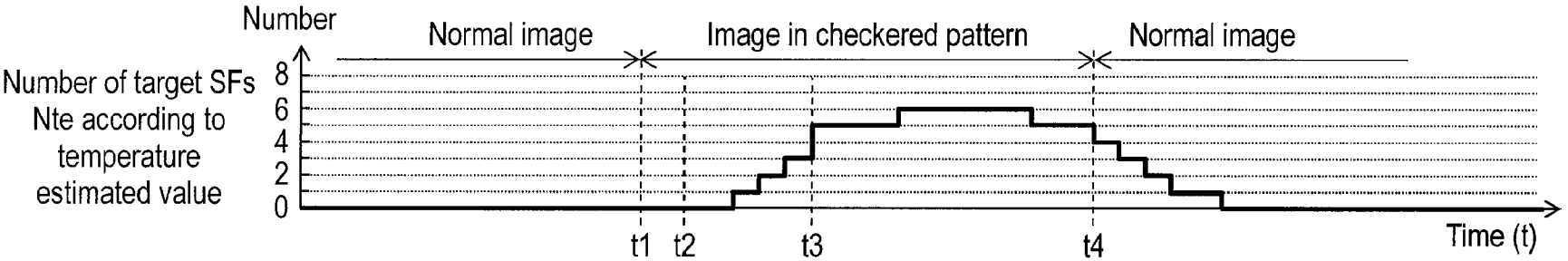
FIG. 7C is a diagram showing the example of the operation of generating the conversion control data and the number of target subfields determined by a number of target subfields determination circuit according to a temperature estimated value in the plasma display device in accordance with the first exemplary embodiment of the present invention.
Figure 7D:
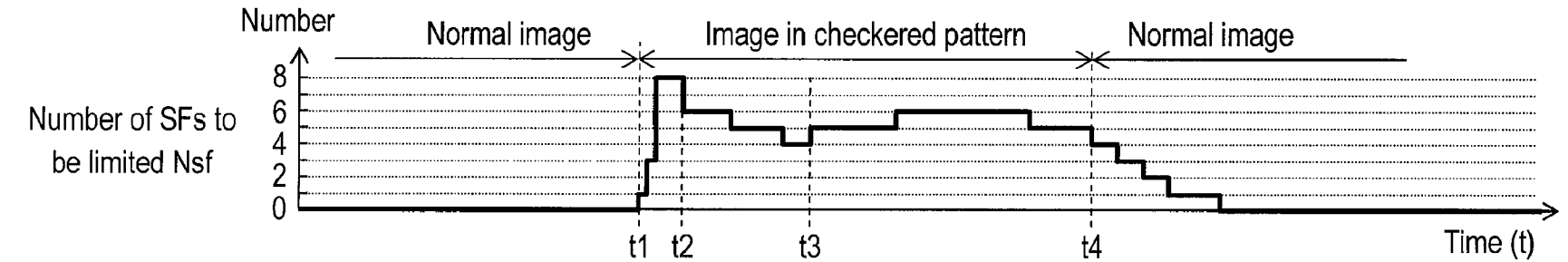
FIG. 7D is a diagram showing the example of the operation of generating the conversion control data and the number of subfields to be limited, i.e. the larger one of the numbers of target subfields detected by a maximum value detector, in the plasma display device in accordance with the first exemplary embodiment of the present invention.

FIG. 7B shows number of target SFs Npe that number of target SFs determination circuit 45 determines according to power estimated value PE of FIG. 7A. FIG. 7C shows number of target SFs Nte that number of target SFs determination circuit 44 determines according to temperature estimated value TE of FIG. 7A. FIG. 7D shows number of SFs to be limited Nsf, i.e. the larger one of number of target SFs Npe and number of target SFs Nte that maximum value detector 433 detects.

First, in the period until time t1 of FIGS. 7A, 7B, 7C, and 7D, normal image signals are supplied. In this period, the relations of lighting states between adjacent discharge cells are at random. Thus, the power consumption of each drive IC 521 does not increase extremely. The number of changes in the address pulse voltage applied to the adjacent discharge cells that each load calculation circuit 601 detects does not increase extremely. As a result, the load values supplied from each load calculation circuit 601 are at an average level, for example.

For this reason, as shown in FIG. 7A, power estimated value PE supplied from power calculation circuit 62 is equal to or smaller than power minimum threshold value Pth_min in number of target SFs determination circuit 45. As a result, as shown in FIG. 7B, in the period until time t1, number of target SFs determination circuit 45 outputs 0 as number of target SFs Npe. Similarly, temperature estimated value TE supplied from temperature calculation circuit 61 is equal to or smaller than temperature minimum threshold value Tth_min in number of target SFs determination circuit 44. As a result, as shown in FIG. 7C, in the period until time t1, number of target SFs determination circuit 44 also outputs 0 as number of target SFs Nte. In the period until t1, maximum value detector 433 selects either value of number of target SFs Npe and number of target SFs Nte because number of target SFs Npe and number of target SFs Nte are equal at 0 in this period. Then, the maximum value detector outputs a conversion control data for setting number of SFs to be limited Nsf at 0, as shown in FIG. 7D.

Second image converter 42 receives such a conversion data for setting number of SFs to be limited Nsf at 0, and makes all the SFs subjected to address operation according to the conversion data. In other words, when number of SFs to be limited Nsf is 0, second image converter 42 does not change the image data generated by first image converter 41 according to the predetermined coding as shown in FIG. 5A and supplies the image data in blocks to corresponding drive ICs 521 of data electrode driver circuit 52. The plasma display device of this exemplary embodiment performs display processing using all the set SFs by the above operation in such a case where normal image signals are supplied.

Next, a description is provided of a case where image signals that make the lighting states of adjacent discharge cells into an inverted relation and provide an image in a checkered pattern are supplied from time t1 to time t4 of FIGS. 7A, 7B, 7C, and 7D. Input of such image signals increases the number of changes in address pulse voltage as described above, thus increasing the power consumption of each drive IC 521. Because each load calculation circuit 601 detects such the increased number of changes in address pulse voltage, the load value supplied from each load calculation circuit 601 rapidly increases. Thus, power estimated value PE supplied from power calculation circuit 62 rapidly increases and exceeds power maximum threshold value Pth_max in number of target SFs determination circuit 45, from time t1 to time t2, as shown in FIG. 7A. As a result, as shown in FIG. 7B, in the period from time t1 to time t2, number of target SFs determination circuit 45 outputs 1, 3, and 8 in this order, as numbers of target SFs Npe.

On the other hand, each accumulator 611 in temperature calculation circuit 61 performs cumulative operation on the load values supplied from corresponding load calculation circuit 601. Thus, as shown in FIG. 7A, temperature estimated value TE not rapidly but slowly increases after time t1. For this reason, as shown in FIG. 7C, in the period from time t1 to time t2, number of target SFs determination circuit 44 outputs 0 as number of target SFs Nte.

Maximum value detector 433 detects the larger one of number of target SFs Npe and number of target SFs Nte. Thus, as shown in FIG. 7D, in the period from time t1 to time t2, maximum value detector 433 selects numbers of target SFs Npe, and outputs a conversion control data showing 1, 3, and 8 in this order as numbers of SFs to be limited Nsf. Because second image converter 42 receives the conversion control data for setting 1, 3, and 8 in this order as numbers of SFs to be limited Nsf, the second image converter changes the data into an image data in which address operation is stopped by the number of SFs based on number of SFs to be limited Nsf. In other words, when number of SFs to be limited Nsf is 1, second image converter 42 sets the first SF to be limited and converts the image data supplied from first image converter 41 into an image data according to a changed coding in which no address operation is to be performed in the first SF. Similarly, when number of SFs to be limited Nsf is 3, second image converter 42 sets the first to the third SFs to be limited, and converts the image data supplied from first image converter 41 into an image data according to a changed coding in which no address operation is to be performed in the first to the third SFs. When number of SFs to be limited Nsf is 8, second image converter 42 sets the first to the eighth SFs to be limited, and converts the image data supplied from first image converter 41 into an image data according to a changed coding in which no address operation is to be performed in the first to the eighth SFs. In this manner, when image signals that rapidly increase power consumption are supplied, in response to the rapid increase in power consumption, second image converter 42 changes the received image data into an image data that rapidly decreases the power consumption, by feedback control through power calculation circuit 62.

As shown in FIG. 7A, in the period from time t1 to time t2, by such feedback control through power calculation circuit 62, the first to the eighth SFs are set to be limited and the supplied image data is changed into an image data that rapidly decreases the power consumption. Thus, the power consumption of each drive IC 521 having rapidly increased once begins to decrease from around time t2. In other words, also from time t2 to time t3, such an operation of feedback control through power calculation circuit 62 still continues. The power consumption of each drive IC 521 gradually decreases. With this decrease, power estimated value PE gradually decreases, and number of target SFs Npe gradually decreases to 6 and 5, as shown in FIG. 7B.

On the other hand, an increase in the power consumption caused by the change of image signals from time t1 gradually increases the temperature of each drive IC 521 from around time t2. With this increase, temperature estimated value TE gradually increases. For this reason, as shown in FIG. 7A, temperature estimated value TE exceeds temperature minimum threshold value Tth_min in number of target SFs determination circuit 45. Thus, as shown in FIG. 7C, from around the midterm between time t2 and time t3, number of target SFs determination circuit 44 outputs 1, 2, and 3 in this order, as numbers of target SFs Nte.

When number of target SFs Npe and number of target SFs Nte are compared with each other in the period from time t2 to time t3, number of target SFs Npe is still larger as shown in FIGS. 7B and 7C. Thus, maximum value detector 433 selects the larger number, i.e. number of target SFs Npe, also in the period from time t2 to time t3, and outputs 6, 5, and 4 in this order as a conversion control data showing numbers of SFs to be limited Nsf, as shown in FIG. 7D. Further, second image converter 42 outputs an image data in which address operation is stopped in the target SFs according to such numbers of SFs to be limited Nsf. In this manner, even after image signals rapidly increasing the power consumption are supplied, as shown in the period from time t2 to time t3, feedback control through power calculation circuit 62 causes the operation for gradually decreasing the power consumption of each drive IC 521.

In the period from time t3 to time t4, the above feedback control substantially stabilizes the power consumption of each drive IC 521, power estimated value PE, and number of target SFs Npe at certain values. On the other hand, the temperature of each drive IC 521 is continuously and gradually increased for the time being even after time t3 by an increase in the power consumption from time t1. With this increase, temperature estimated value TE and number of target SFs Nte gradually increase. For this reason, as shown in FIGS. 7B and 7C, after time t3, number of target SFs Nte is larger than number of target SFs Npe. Thus, maximum value detector 433 selects number of target SFs Nte, and outputs conversion control data showing 5, 6, and 5 in this order as a numbers of SFs to be limited Nsf, as shown in FIG. 7D.

Further, second image converter 42 outputs an image data in which address operation is stopped in the target SFs according to such numbers of SFs to be limited Nsf. In this manner, when a period of time has elapsed after input of image signals increasing the power consumption, the control mode is changed to feedback control through temperature calculation circuit 61 to cause the operation for suppressing the temperature increase as well as power consumption of each drive IC 521. Like conversion control data generator 43, a structure in which maximum value detector 433 obtains the larger value of number of target SFs Npe based on power consumption and number of target SFs Nte based on temperature can suppress the power consumption of each drive IC 521 on the basis of at least one of power consumption and temperature. Further, the feedback control of power consumption and the feedback control of temperature can be switched with a simplified structure.

As described above, when image signals increasing the power consumption of data electrode driver circuit 52 are supplied as shown in the period from time t1 to time t4, first, the plasma display device of this exemplary embodiment promptly responds to increases in the power consumption and operates to rapidly decrease the power consumption by feedback control through power calculation circuit 62 that suppresses the power consumption. Thereafter, the plasma display device responds to the gradually increasing temperature and operates to suppress increases in the temperature as well as power consumption by feedback control through temperature calculation circuit 61 that suppresses the temperature increase. With these operations, when image signals increasing the power consumption are supplied, the plasma display device of this exemplary embodiment more promptly suppresses the power consumption and thereby temperature increase than the method of decreasing the temperature of the data electrode driver circuit by temperature feedback control.

When the display image is changed to a normal image at time t4, the number of changes in address pulse voltage decreases, and thus the load values supplied from each load calculation circuit 601 decreases. With this decrease, power estimated value PE and number of target SFs Npe decrease, and temperature estimated value TE and number of target SFs Nte slowly decrease. Thereafter, when number of SFs to be limited Nsf decreases to 0 in the conversion control data, image signal conversion circuit 40 supplies the image data according to the predetermined coding as shown in FIG. 5A in blocks to corresponding drive ICs 521 of data electrode driver circuit 52. Panel 10 displays an image according to the predetermined coding in which all the SFs are subjected to address operation. Changing the coding to reduce the power consumption of data electrode driver circuit 52 in the above manner reduces the number of displayable brightness. However, the image signals increasing the power consumption of data electrode driver circuit 52 provide an image in which the brightness considerably varies by pixel or by small region, and thus even reducing the number of displayed brightness to some degrees is visually recognizable in few cases.

As described above, the plasma display device of this exemplary embodiment includes power calculation circuit 62 for calculating a power consumption of data electrode driver circuit 52 according to an image data, and temperature calculation circuit 61 for calculating a temperature of data electrode driver circuit 52 according to the image data. When the calculated power consumption exceeds a predetermined power threshold value or the calculated temperature exceeds a predetermined temperature threshold value, image signal conversion circuit 40 converts the image signal into an image data decreasing the power consumption of data electrode driver circuit 52.

With such a structure, when an image signal increasing the power consumption is supplied, the plasma display device of this exemplary embodiment, first, rapidly decreases the power consumption by feedback control through power calculation circuit 62 that suppresses the power consumption. Thereafter, the plasma display device suppresses increases in temperature as well as power consumption by feedback control through temperature calculation circuit 61 that suppresses temperature increase. Thus, the present invention can provide a plasma display device capable of promptly responding to a rapid increase in power consumption or the like, and making stable operation to display images without causing malfunction of the data electrode driver circuit.

Second Exemplary Embodiment

Figure 8:
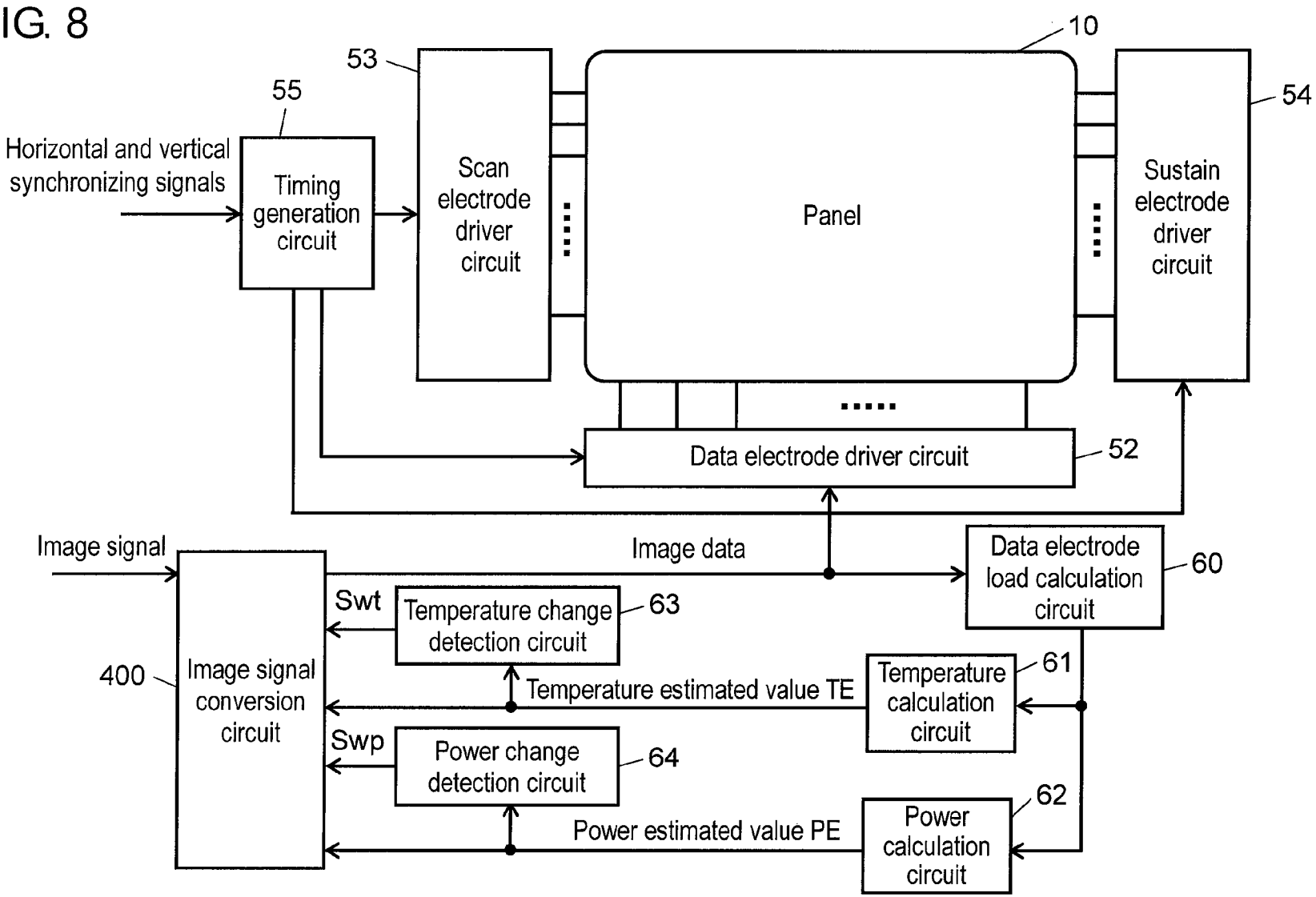
FIG. 8 is a circuit block diagram of a plasma display device in accordance with a second exemplary embodiment of the present invention.

FIG. 8 is a circuit block diagram of a plasma display device in accordance with the second exemplary embodiment of the present invention. The plasma display device of this exemplary embodiment includes the following elements: panel 10; image signal conversion circuit 400; data electrode driver circuit 52; scan electrode driver circuit 53; sustain electrode driver circuit 54; timing generation circuit 55; data electrode load calculation circuit 60; temperature calculation circuit 61 as a temperature calculator; power calculation circuit 62 as a power calculator; temperature change detection circuit 63 as a temperature change detector; power change detection circuit 64 as a power change detector; and a power supply (not shown) for supplying power necessary for the respective circuit blocks. In FIG. 8, elements denoted with the same reference marks as those in FIG. 4 have the same functions as those in FIG. 4, and detailed descriptions of those elements are omitted.

With reference to FIG. 8, similar to image signal conversion circuit 40 of the first exemplary embodiment, image signal conversion circuit 400 converts a supplied image signal into an image data showing whether to light discharge cells or not for each subfield (SF). Image signal conversion circuit 400 also changes a coding, according to a conversion control data similar to that of the first exemplary embodiment. In other words, image signal conversion circuit 400 is a circuit that converts an image signal into an image data that causes the discharge cells to be lit or unlit in each SF period. Particularly in this conversion processing, at least when the power consumption of data electrode driver circuit 52 is larger than a predetermined power threshold value or when the temperature thereof is larger than a predetermined temperature threshold value, image signal conversion circuit 400 converts the image signal into an image data that decreases the power consumption of data electrode driver circuit 52.

Image signal conversion circuit 400 supplies the thus generated image data to data electrode driver circuit 52. Data electrode driver circuit 52 converts the image data for each SF into the signals corresponding to data electrodes D1 to Dm, and drives respective data electrodes D1 to Dm.

The image data generated by image signal conversion circuit 400 is also supplied to data electrode load calculation circuit 60. Data electrode load calculation circuit 60 calculates the load amount of data electrode driver circuit 52 in each field by computing.

Temperature calculation circuit 61 calculates a temperature in data electrode driver circuit 52 by performing further computations on the load values calculated by data electrode load calculation circuit 60. Power calculation circuit 62 calculates a power consumption in data electrode driver circuit 52 by performing further computations on the load values calculated by data electrode load calculation circuit 60. In this manner, temperature calculation circuit 61 calculates the temperature in data electrode driver circuit 52 according to the image data supplied from image signal conversion circuit 400. Power calculation circuit 62 calculates the power consumption in data electrode driver circuit 52 according to the image data supplied from image signal conversion circuit 400.

Temperature calculation circuit 61 informs image signal conversion circuit 400 and temperature change detection circuit 63 of the calculated temperature as temperature estimated value TE. Power calculation circuit 62 informs image signal conversion circuit 400 and power change detection circuit 64 of the calculated power consumption as power estimated value PE.

According to informed temperature estimated value TE, temperature change detection circuit 63 detects, for each field, a temperature change direction showing whether temperature estimated value TE is increased or decreased, and informs image signal conversion circuit 400 of the direction as temperature change direction signal Swt. According to informed power estimated value PE, power change detection circuit 64 detects, for each field, a power change direction showing whether power estimated value PE is increased or decreased, and informs image signal conversion circuit 400 of the direction as power change direction signal Swp. The details are described below. In order to control the power consumption in data electrode driver circuit 52, image signal conversion circuit 400 generates the above conversion control data based on the determination of whether or not temperature estimated value TE is larger than the temperature threshold value changed corresponding to temperature change direction Swt and the determination of whether or not power estimated value PE is larger than the power threshold value changed corresponding to power change direction Swp.

In other words, image signal conversion circuit 400 has a first temperature threshold value, and a second temperature threshold value smaller than the first temperature threshold value, as the temperature threshold values, and a first power threshold value, and a second power threshold value smaller than the first power threshold value, as the power threshold values. According to these threshold values, image signal conversion circuit 400 determines whether temperature estimated value TE and power estimated value PE exceed or are equal to or smaller than these threshold values. Then, the image signal conversion circuit generates a conversion control data based on this determination. In this manner, the plasma display device of this exemplary embodiment includes temperature change detection circuit 63 for detecting a temperature change direction of whether temperature estimated value TE is increased or decreased per unit time, and power change detection circuit 64 for detecting a power change direction of whether power estimated value PE is increased or decreased per unit time. At least when power estimated value PE exceeds the first power threshold value or when the temperature estimated value exceeds the first temperature threshold value, image signal conversion circuit 400 converts the image signal into an image data decreasing the power consumption of data electrode driver circuit 52. Further, image signal conversion circuit 400 converts the image signal into an image data increasing the power consumption of data electrode driver circuit 52 at least when power estimated value PE is equal to or smaller than the second power threshold value or when temperature estimated value TE is equal to or smaller than the second temperature threshold value.

In this exemplary embodiment, a description is provided of a structural example in which the plasma display device includes both temperature change detection circuit 63 and power change detection circuit 64. However, the plasma display device may be structured to include either one of temperature change detection circuit 63 and power change detection circuit 64 and change the corresponding one of the temperature threshold value and power threshold value according to the change direction. In other words, the plasma display device may be structured to convert an image signal into an image data decreasing the power consumption of data electrode driver circuit 52 at least when power estimated value PE exceeds the predetermined power threshold value, or when the temperature estimated value exceeds the first temperature threshold value. Further, the plasma display device may be structured to convert the image signal into an image data increasing the power consumption of data electrode driver circuit 52 at least when power estimated value PE is equal to or smaller than the predetermined power threshold value, or when temperature estimated value TE is equal to or smaller than the second temperature threshold value. Alternatively, the plasma display device may be structured to convert the image signal into an image data decreasing the power consumption of data electrode driver circuit 52 at least when power estimated value PE exceeds the first power threshold value, or when the temperature estimated value exceeds the predetermined temperature threshold value. Further, the plasma display device may be structured to convert the image signal into an image data increasing the power consumption of data electrode driver circuit 52 at least when power estimated value PE is equal to or smaller than the second power threshold value, or when temperature estimated value TE is equal to or smaller than the predetermined temperature threshold value. In the description of this exemplary embodiment, the plasma display device is structured so that temperature change detection circuit 63 and power change detection circuit 64 detect changes per field. However, the plasma display device may be structured so that such a circuit detects changes per several fields, for example, i.e. determines whether the change is an increase or decrease per unit time in temperature or power.

Image signal conversion circuit 400 generates a conversion control data for controlling conversion of an image signal according to temperature estimated value TE, temperature change direction signal Swt, power estimated value PE, and power change direction signal Swp, and outputs an image data generated according to a coding based on the conversion control data.

With the above structure, in the plasma display device of this exemplary embodiment, power calculation circuit 62 calculates the power consumption of data electrode driver circuit 52, and temperature calculation circuit 61 calculates the temperature of data electrode driver circuit 52, according to an image data supplied from image signal conversion circuit 400. Temperature change detection circuit 63 detects a temperature change direction per unit time, and power change detection circuit 64 detects a power change direction per unit time. Further, image signal conversion circuit 400 generates a conversion control data based on the calculated power consumption and temperature, using a temperature threshold value corresponding to the temperature change direction and a power threshold value corresponding to the power change direction. When it is determined according to this conversion control data that at least one of the power consumption and the temperature of data electrode driver circuit 52 is increased, the predetermined coding is changed to a coding in which no address operation is performed in a SF having a smaller brightness weight. The plasma display device of this exemplary embodiment controls the power consumption adaptively for image signals by performing such a feedback processing.

Figure 9:
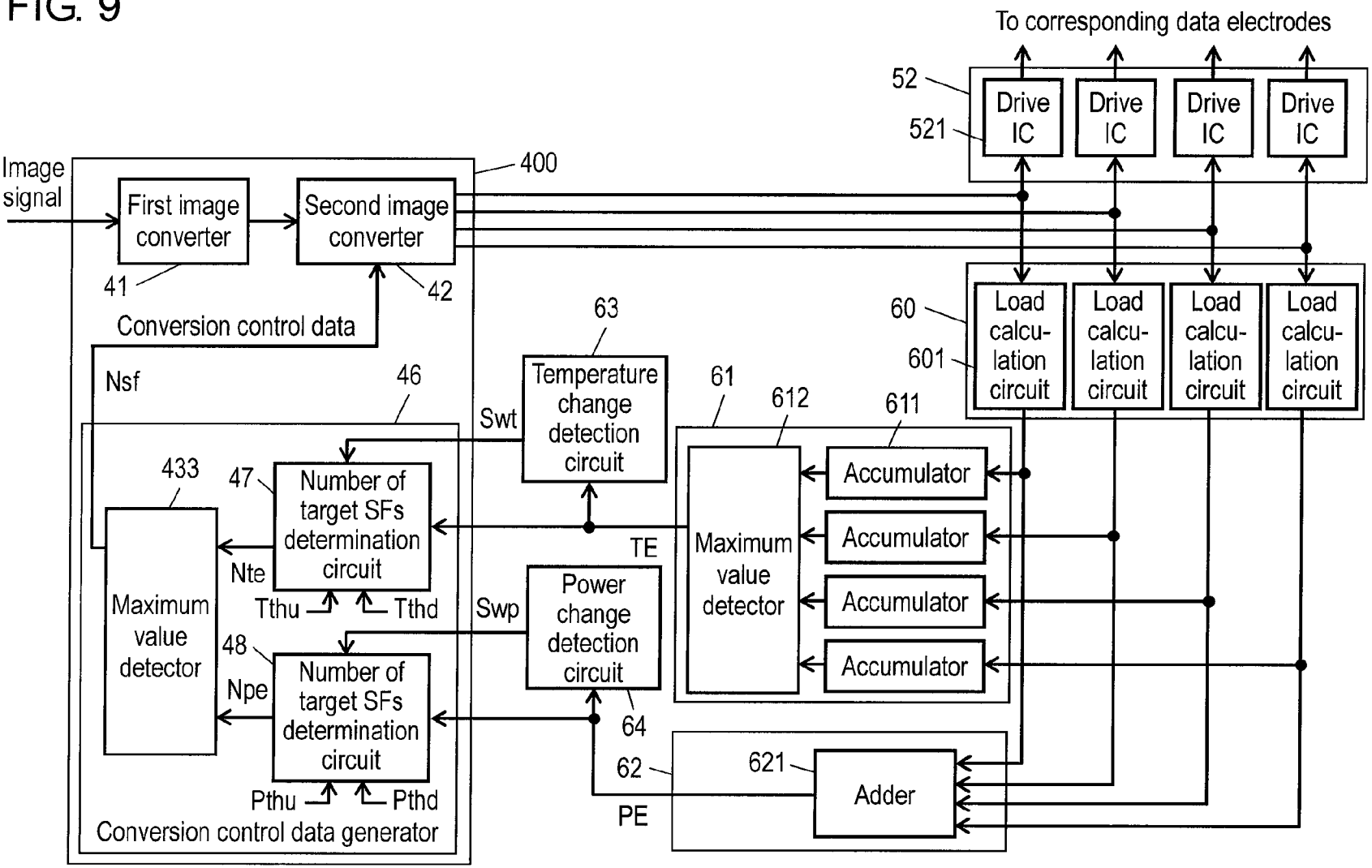
FIG. 9 is a circuit block diagram showing a detailed example of an essential part of a circuit structure for controlling power consumption of the plasma display device in accordance with the second exemplary embodiment of the present invention.

Next, a description is provided of a more detailed structure for adaptively controlling the power consumption in the plasma display device of this exemplary embodiment. FIG. 9 is a circuit block diagram showing a detailed structural example of an essential part of the circuit structure for controlling the power consumption of the plasma display device in accordance with the second exemplary embodiment of the present invention. Also in this example, similar to the first exemplary embodiment, data electrode driver circuit 52 is formed of a plurality of integrated circuits working as drivers, i.e. drive ICs. As an example, a description is provided of data electrode driver circuit 52 that includes the plurality of drivers corresponding to data electrodes 32 of panel 10 divided into blocks. Shown in FIG. 9 is an example of a structure in which data electrode driver circuit 52 includes four of such drive ICs 521 and calculates the power consumption and temperature for each drive IC 521. In FIG. 9, the elements denoted with the same reference marks as those in FIG. 6 have the same functions as those in FIG. 6, and the detailed description thereof are omitted.

As shown in FIG. 9, image signal conversion circuit 400 includes first image converter 41, second image converter 42, and conversion control data generator 46. First image converter 41 converts a supplied image signal into an image data showing whether to light the cells or not for each SF, according to a predetermined coding. Second image converter 42 converts the image data according to the predetermined coding into an image data according to a coding in which no address operation is performed in a SF having a smaller brightness weight, on the basis of the conversion control data informed by conversion control data generator 46. Further, conversion control data generator 46 generates such a conversion control data for controlling the change.

With reference to FIG. 9, for temperature estimated values TE informed from temperature calculation circuit 61, temperature change detection circuit 63 compares current temperature estimated value TE with temperature estimated value TE informed in the preceding field, for example. Temperature change detection circuit 63 determines according to this comparison whether temperature estimated value TE is increased or decreased. Further, temperature change detection circuit 63 informs image signal conversion circuit 400 of the thus determined result as temperature change direction signal Swt. On the other hand, for power estimated values PE informed from power calculation circuit 62, power change detection circuit 64 compares current power estimated value PE with power estimated value PE informed in the preceding field, for example. Power change detection circuit 64 determines according to this comparison whether power estimated value PE is increased or decreased. Further, power change detection circuit 64 informs image signal conversion circuit 400 of the thus determined result as power change direction signal Swp.

Temperature estimated value TE from temperature calculation circuit 61, temperature change direction signal Swt from temperature change detection circuit 63, power estimated value PE from power calculation circuit 62, and power change direction signal Swp from power change detection circuit 64 are informed to conversion control data generator 46 in image signal conversion circuit 400. Conversion control data generator 46 includes number of target SFs determination circuit 47 for determining the number of SFs according to temperature estimated value TE, number of target SFs determination circuit 48 for determining the number of SFs according to power estimated value PE, and maximum value detector 433 for detecting and outputting the maximum value of the output values from number of target SFs determination circuit 47 and number of target SFs determination circuit 48. The number of SFs determined by number of target SFs determination circuit 47 and the number of SFs determined by number of target SFs determination circuit 48 correspond to the numbers of SFs in which no address operation is to be performed.

Conversion control data generator 46 stores temperature threshold value Tthu as a first temperature threshold value and temperature threshold value Tthd as a second temperature threshold value that show predetermined temperature values, and power threshold value Pthu as a first power threshold value and power threshold value Pthd as a second power threshold value that show predetermined power values. Temperature threshold value Tthu and temperature threshold value Tthd are informed to number of target SFs determination circuit 47. Temperature threshold value Tthu and temperature threshold value Tthd are temperature threshold values provided so that either one of the values is selected corresponding to the temperature change direction based on temperature estimated value TE. Temperature threshold value Tthu is selected at a temperature increase and temperature threshold value Tthd is selected at a temperature decrease. Temperature threshold value Tthu is set larger than temperature threshold value Tthd. On the other hand, power threshold value Pthu and power threshold value Pthd are informed to number of target SFs determination circuit 48. Power threshold value Pthu and power threshold value Pthd are power threshold values provided so that either one of the values is selected corresponding to the power change direction based on power estimated value PE. Power threshold value Pthu is selected at a power increase and power threshold value Pthd is selected at a power decrease. Power threshold value Pthu is set larger than power threshold value Pthd.

Number of SFs determination circuit 47 in conversion control data generator 46 first selects either one of temperature threshold value Tthu and temperature threshold value Tthd corresponding to informed temperature change direction signal Swt. When temperature change direction signal Swt shows that temperature estimated value TE is increased, number of target SFs determination circuit 47 selects temperature threshold value Tthu. When the temperature change direction signal shows that temperature estimated value TE is decreased, the number of target SFs determination circuit selects temperature threshold value Tthd.

Next, number of target SFs determination circuit 47 determines the number of target SFs based on a selected one of temperature threshold value Tth, and outputs the determined number as number of target SFs Nte. In other words, in determination of number of target SFs Nte, i.e. the number of SFs according to temperature estimated value TE, number of target SFs determination circuit 47 determines number of target SFs Nte according to a determination method having hysteresis characteristics in which the correlations between temperature estimated value TE and number of target SFs Nte are different corresponding to the temperature change direction. Specifically, temperature threshold value Tthu and temperature threshold value Tthd, i.e. at least one combination with respect to temperature estimated value TE, are informed to target SFs determination circuit 47. Thus, number of target SFs determination circuit 47 compares temperature estimated value TE informed for each field with a value of temperature threshold value Tth corresponding to the temperature change direction, and determines whether temperature estimated value TE has exceeded temperature threshold value Tth showing a predetermined temperature. On the basis of this determination result, number of target SFs determination circuit 47 determines the number of target SFs.

Figure 10A:
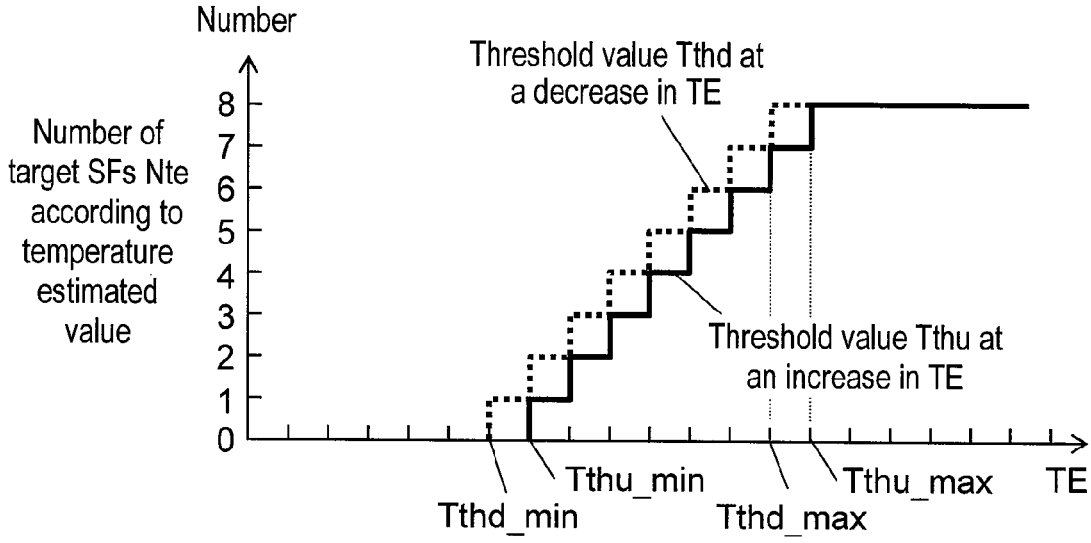
FIG. 10A is a diagram showing an example of temperature threshold values Tthu and temperature threshold values Tthd set to determine number of target subfields Nte in accordance with the second exemplary embodiment of the present invention.

FIG. 10A is a diagram showing an example of temperature threshold values Tthu and temperature threshold values Tthd set to determine number of target SFs Nte in the second exemplary embodiment of the present invention. In this example, the number of target SFs Nte is changed from 0 to 8. For this change, eight combinations of temperature threshold value Tthu and temperature threshold value Tthd are set. In FIG. 10A, the solid line shows temperature threshold values Tthu each corresponding to a temperature increase, i.e. threshold values in eight steps from temperature minimum threshold value Tthu_min having the smallest value to temperature maximum threshold value Tthu_max having the largest value. The broken line shows temperature threshold values Tthd corresponding to a temperature decrease, i.e. threshold values in eight steps from temperature minimum threshold value Tthd_min having the smallest value to temperature maximum threshold value Tthd_max having the largest value.

For these temperature threshold values, at an increase in temperature estimated value TE, for example, number of target SFs determination circuit 47 first outputs 0 as number of target SFs Nte when temperature estimated value TE is equal to or smaller than temperature threshold value Tthu_min. With an increase in temperature estimated value TE, number of target SFs determination circuit 47 next outputs 1 as number of target SFs Nte when temperature estimated value TE exceeds temperature threshold value Tthu_min. Similarly, with sequential increases in temperature estimated value TE, number of target SFs determination circuit 47 outputs numbers of target SFs Nte according to temperature threshold values Tthu set in FIG. 10A.

In contrast, at a decrease in temperature estimated value TE, for example, number of target SFs determination circuit 47 first outputs 8 as number of target SFs Nte when temperature estimated value TE exceeds temperature threshold value Tthd_max. With a decrease in temperature estimated value TE, number of target SFs determination circuit 47 next outputs 7 as number of target SFs Nte when temperature estimated value TE is decreased to temperature threshold value Tthd_max or smaller. Similarly, with sequential decreases in temperature estimated value TE, number of target SFs determination circuit 47 outputs numbers of target SFs Nte according to temperature threshold values Tthd set in FIG. 10A.

On the other hand, number of SFs determination circuit 48 first selects either one of power threshold value Pthu and power threshold value Pthd corresponding to informed power change direction signal Swp. When power change direction signal Swp shows that power estimated value PE is increased, number of target SFs determination circuit 48 selects power threshold value Pthu. When the power change direction signal shows that power estimated value PE is decreased, number of target SFs determination circuit 48 selects power threshold value Pthd.

Next, number of target SFs determination circuit 48 determines the number of target SFs based on a selected one of power threshold value Pth, and outputs the determined number as number of target SFs Npe. In other words, number of target SFs determination circuit 48 has hysteresis characteristics corresponding to the change direction of power estimated value PE, and outputs number of target SFs Npe corresponding to the change direction and value of power estimated value PE. Specifically, power threshold value Pthu and power threshold value Pthd, i.e. at least one combination corresponding to power estimated value PE, are informed to target SFs determination circuit 48, similar to number of target SFs determination circuit 47. Thus, number of target SFs determination circuit 48 compares power estimated value PE informed for each field with a value of power threshold value Pth corresponding to the power change direction, and determines whether power estimated value PE has exceeded power threshold value Pth showing a predetermined power. On the basis of this determination result, number of target SFs determination circuit 48 determines the number of target SFs.

Figure 10B:
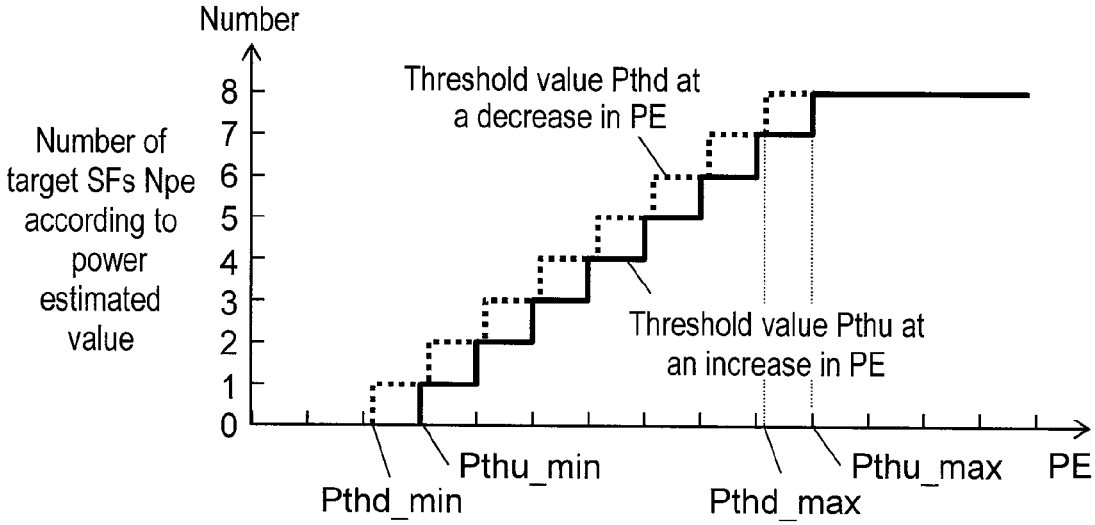
FIG. 10B is a diagram showing an example of power threshold values Pthu and power threshold values Pthd set to determine number of target subfields Npe in accordance with the second exemplary embodiment of the present invention.

FIG. 10B is a diagram showing an example of power threshold values Pthu and power threshold values Pthd set to determine the number of target SFs, i.e. number of target SFs Npe, in the second exemplary embodiment of the present invention. Also in this example, similar to number of target SFs Nte, the number of target SFs Npe is changed from 0 to 8. For this change, eight combinations of power threshold value Pthu and power threshold value Pthd are set. In FIG. 10B, the solid line shows power threshold values Pthu corresponding to a power increase, i.e. threshold values in eight steps from power minimum threshold value Pthu_min having the smallest value to power maximum threshold value Pthu_max having the largest value. The broken line shows power threshold values Pthd corresponding to a power decrease, i.e. threshold values in eight steps from power minimum threshold value Pthd_min having the smallest value to power maximum threshold value Pthd_max having the largest value.

Also for such power threshold values, similar to number of target SFs determination circuit 47, number of target SFs determination circuit 48 outputs numbers of target SFs Npe corresponding to power threshold values Pthu set in FIG. 10B with sequential increases in power estimated value PE. Further, number of target SFs determination circuit 48 outputs numbers of target SFs Npe corresponding to power threshold values Pthd set in FIG. 10B with sequential decreases in power estimated value PE.

Maximum value detector 433 detects the larger value of number of target SFs Nte determined by number of target SFs determination circuit 47 and number of target SFs Npe determined by number of target SFs determination circuit 48, and sets the detected value as number of SFs to be limited Nsf Maximum value detector 433 informs second image converter 42 of number of SFs to be limited Nsf as a conversion control data. With this structure, conversion control data generator 46 sets the larger one of number of target SFs Nte based on the temperature and number of target SFs Npe based on the power consumption, as the number of SFs in which no address operation is to be performed from the SF having the smallest brightness weight in order, i.e. number of SFs to be limited Nsf, which is the number of SFs is to be limited. Conversion control data generator 46 informs second image converter 42 of number of SFs to be limited Nsf, as the conversion control data.

In this manner, second image converter 42 sets the number of SFs in which no address operation is to be performed from the SF having the smallest brightness weight, according to the number of SFs shown in the informed conversion control data, i.e. number of SFs to be limited Nsf. Then, the second image converter converts an image data according to a predetermined coding as shown in FIG. 5A into an image data according to a coding as shown in FIG. 5B or FIG. 5C, i.e. an image data that decreases the power consumption of data electrode driver circuit 52.

As described above, conversion control data generator 46 in image signal conversion circuit 400 informs second image converter 42, as a conversion control data, of number of SFs to be limited Nsf generated on the basis of determination of at least whether the power consumption of data electrode driver circuit 52 exceeds or is equal to or smaller than a predetermined power threshold value corresponding to the power change direction, or whether the temperature thereof exceeds or is equal to or smaller than a predetermined temperature threshold value corresponding to the temperature change direction. Then, according to this conversion control data, second image converter 42 converts the image data into an image data that decreases or increases the power consumption of data electrode driver circuit 52.

FIGS. 11A, 11B, 11C, and 11D are diagrams showing an example of the operation of generating a conversion control data based on power estimated value PE and temperature estimated value TE in the plasma display device of the second exemplary embodiment of the present invention. Hereinafter, a description is provided of the operation of controlling the power consumption of data electrode driver circuit 52 adaptively for image signals in the structure of FIG. 9, with reference to FIGS. 11A, 11B, 11C, and 11D. A description is provided of an example in which the number of all the SFs is 10 and the number of SFs to be limited is changeable from 1 to 8, similar to the case of FIGS. 7A, 7B, 7C, and 7D.

In other words, the first to tenth SFs as shown in FIG. 5A are set as SFs, and according to the conversion control data, control is made to change the predetermined coding to those ranging from a coding of FIG. 5B in which no address operation is performed in the first SF having the smallest brightness weight to a coding in which no address operation is performed in the first to the eighth SFs. Specifically in this example, when number of SFs to be limited Nsf is 0 in the conversion control data, all the SFs are subjected to address operation. When number of SFs to be limited Nsf is 1, the first SF is to be limited. Sequentially, number of SFs to be limited Nsf is increased. Then, when number of SFs to be limited Nsf is 8, the first to the eighth SFs are to be limited. In this description, this number of SFs to be limited Nsf is determined on the basis of characteristics of number of target SFs Nte with respect to temperature estimated value TE shown in FIG. 10A and characteristics of number of target SFs Npe with respect to temperature estimated value PE shown in FIG. 10B.

Figure 11A:
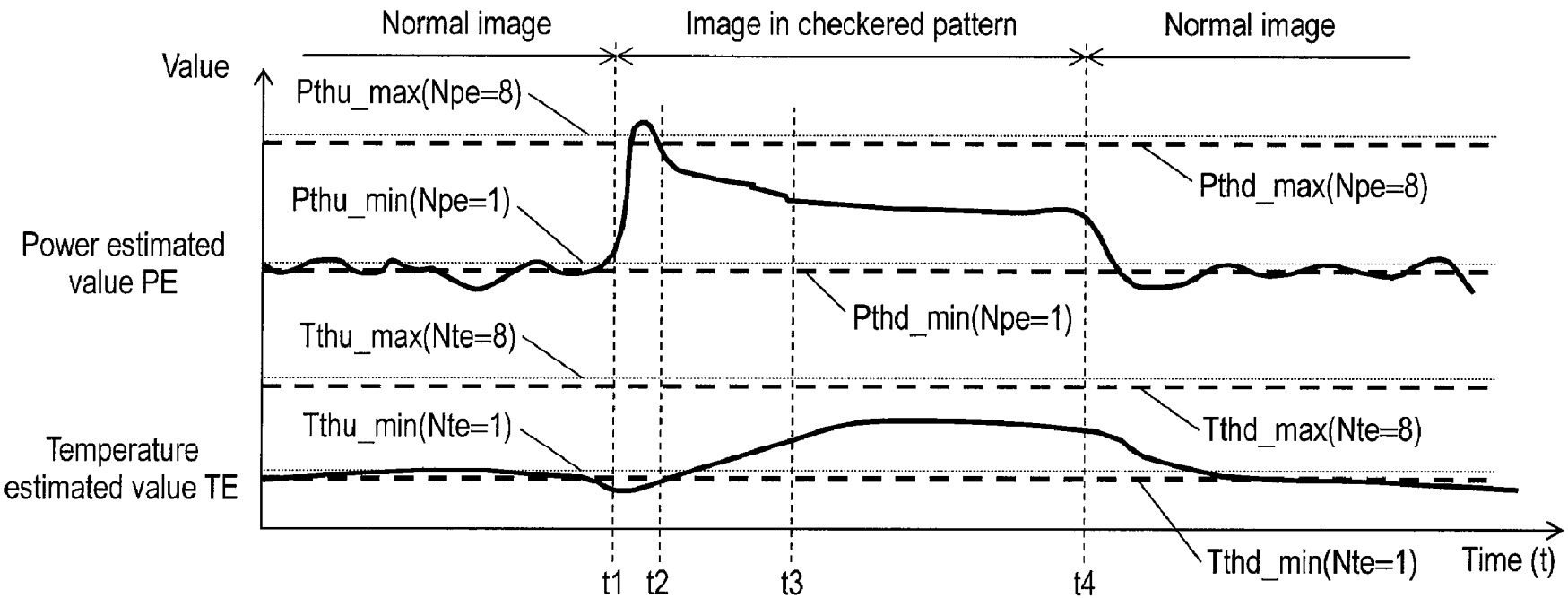
FIG. 11A is a diagram showing an example of the operation of generating a conversion control data in the plasma display device in accordance with the second exemplary embodiment of the present invention.

FIG. 11A shows an example of changes in power estimated value PE and temperature estimated value TE when supplied image signals are switched between normal signals and signals that increase the power consumption of data electrode driver circuit 52 and provide an image in a checkered pattern, for example. FIG. 11A shows a case where normal image signals are supplied until time t1, and image signals for providing an image in a checkered pattern are supplied from time t1 to time t4 and returned to the normal signals after time t4.

FIG. 11A shows temperature maximum threshold value Tthu_max and temperature minimum threshold value Tthu_min, and temperature maximum threshold value Tthd_max and temperature minimum threshold value Tthd_min with which number of target SFs determination circuit 47 determines number of target SFs Nte according to temperature estimated value TE. Temperature maximum threshold value Tthu_max and temperature minimum threshold value Tthu_min correspond to the temperature increasing direction. Temperature maximum threshold value Tthd_max and temperature minimum threshold value Tthd_min correspond to the temperature decreasing direction. FIG. 11A also shows power maximum threshold value Pthu_max and power minimum threshold value Pthu_min, and power maximum threshold value Pthd_max and power minimum threshold value Pthd_min with which number of target SFs determination circuit 48 determines number of target SFs Npe according to power estimated value PE. Power maximum threshold value Pthu_max and power minimum threshold value Pthu_min correspond to the power increasing direction. Power maximum threshold value Pthd_max and power minimum threshold value Pthd_min correspond to the power decreasing direction.

In other words, this is an example in which the number of SFs to be limited is 8. Accordingly, temperature threshold values Tth as shown in FIG. 10A and power threshold values Pth as shown in FIG. 10B are stored in conversion control data generator 46. According to this number, at a temperature increase, for example, number of target SFs determination circuit 47 sets 0 as number of target SFs Nte when temperature estimated value TE is equal to or smaller than temperature minimum threshold value Tthu_min. When temperature estimated value TE exceeds temperature minimum threshold value Tthu_min and is equal to or smaller than the threshold value second to the minimum threshold value, the number of target SFs determination circuit outputs 1 as number of target SFs Nte. Then, number of target SFs determination circuit 47 sequentially increments number of target SFs Nte, corresponding to the respective threshold values. When temperature estimated value TE exceeds temperature maximum threshold value Tthu_max, the number of target SFs determination circuit outputs 8 as number of target SFs Nte. Similarly, at a power increase, for example, number of target SFs determination circuit 48 sets 0 as number of target SFs Npe when power estimated value PE is equal to or smaller than power minimum threshold value Pthu_min. When power estimated value PE exceeds power minimum threshold value Pthu_min and is equal to or smaller than the threshold value second to the minimum threshold value, the number of target SFs determination circuit sets 1 as number of target SFs Npe. Then, number of target SFs determination circuit 48 sequentially increments number of target SFs Npe, corresponding to the respective threshold values. When power estimated value PE exceeds power maximum threshold value Pthu_max, the number of target SFs determination circuit outputs 8 as number of target SFs Npe.

Figure 11B:
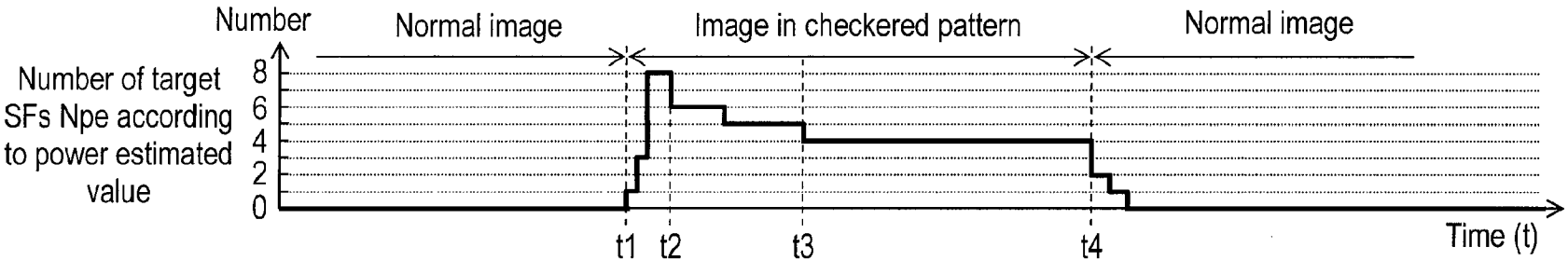
FIG. 11B is a diagram showing an example of the operation of generating the conversion control data and the number of target subfields determined by a number of target subfields determination circuit according to a power estimated value in the plasma display device in accordance with the second exemplary embodiment of the present invention.
Figure 11C:
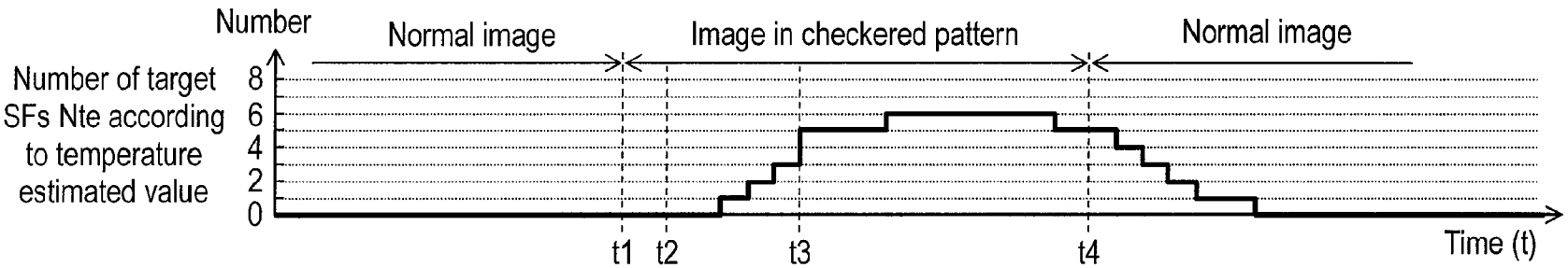
FIG. 11C is a diagram showing an example of the operation of generating the conversion control data and the number of target subfields determined by a number of target subfields determination circuit according to a temperature estimated value in the plasma display device in accordance with the second exemplary embodiment of the present invention.
Figure 11D:
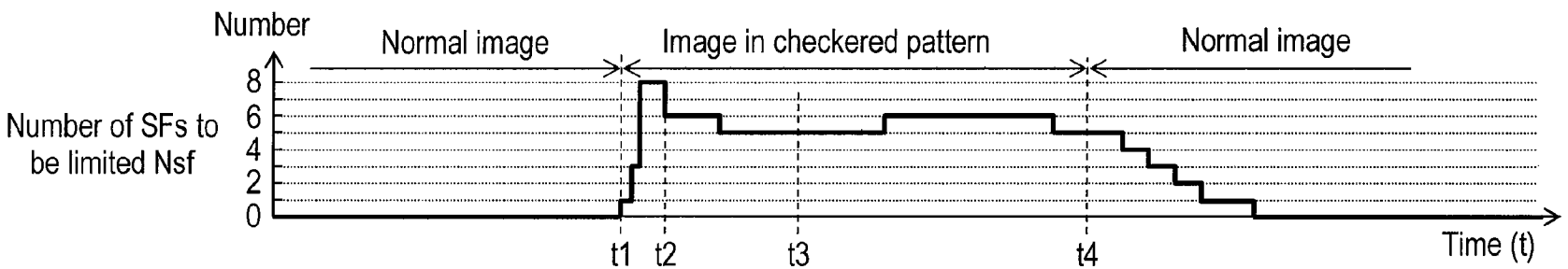
FIG. 11D is a diagram showing an example of the operation of generating the conversion control data and the number of subfields to be limited, i.e. the larger one of the numbers of target subfields detected by a maximum value detector, in the plasma display device in accordance with the second exemplary embodiment of the present invention.

FIG. 11B shows number of target SFs Npe that number of target SFs determination circuit 48 determines according to power estimated value PE of FIG. 11A. FIG. 11C shows number of target SFs Nte that number of target SFs determination circuit 47 determines according to temperature estimated value TE of FIG. 11A. FIG. 11D shows number of SFs to be limited Nsf, i.e. the larger one of number of target SFs Npe and number of target SFs Nte that maximum value detector 433 detects.

First, in the period until time t1 of FIGS. 11A, 11B, 11C, and 11D, normal image signals are supplied. In this period, the relations of lighting states between adjacent discharge cells are at random. Thus, the power consumption of each drive IC 521 does not increase extremely. The number of changes in the address pulse voltage applied to the adjacent discharge cells that each load calculation circuit 601 detects does not increase extremely. As a result, the load values supplied from each load calculation circuit 601 are at an average level, for example.

For this reason, as shown in FIG. 11A, power estimated value PE supplied from power calculation circuit 62 sometimes exceeds power minimum threshold value Pthd_min in the power decreasing direction in number of target SFs determination circuit 48, but is equal to or smaller than power minimum threshold value Pthu_min in the power increasing direction. In other words, because the power estimated value is equal to or smaller than power minimum threshold value Pthu_min in the power increasing direction, number of target SFs Npe is 0. Because the power estimated value is equal to or smaller than power minimum threshold value Pthd_min in the power decreasing direction, number of target SFs Npe is 0 also in this case. As a result, as shown in FIG. 11B, number of target SFs determination circuit 48 outputs 0 as number of target SFs Npe in the period until time t1.

Similarly, temperature estimated value TE supplied from temperature calculation circuit 61 sometimes exceeds temperature minimum threshold value Tthd_min in the temperature decreasing direction in number of target SFs determination circuit 47, but is equal to or smaller than temperature minimum threshold value Tthu_min in the temperature increasing direction. In other words, because the temperature estimated value is equal to or smaller than temperature minimum threshold value Tthu_min in the temperature increasing direction, number of target SFs Nte is 0. Because the temperature estimated value is equal to or smaller than temperature minimum threshold value Tthd_min in the temperature decreasing direction, number of target SFs Nte is 0 also in this case. As a result, as shown in FIG. 11C, number of target SFs determination circuit 47 outputs 0 as number of target SFs Nte in the period until time t1.

In maximum value detector 433, number of target SFs Npe and number of target SFs Nte are equal at 0 in the period until t1. Thus, in such a case, maximum value detector 433 selects either value of number of target SFs Npe and number of target SFs Nte, and outputs a conversion control data in which number of SFs to be limited Nsf is 0, as shown in FIG. 11D. Second image converter 42 receives such a conversion control data for setting number of SFs to be limited Nsf at 0, and makes all the SFs subjected to address operation according to the conversion control data. In other words, when number of SFs to be limited Nsf is 0, second image converter 42 does not change the image data generated according to the predetermined coding of FIG. 5A and supplies the image data in blocks to corresponding drive ICs 521 of data electrode driver circuit 52. The plasma display device of this exemplary embodiment performs display processing using all the set SFs by the above operation in such a case where normal image signals are supplied.

Particularly, in the plasma display panel of this exemplary embodiment, number of target SFs determination circuit 48 determines number of target SFs Npe based on two power threshold values in the power increasing and decreasing directions. Thus, even when the power estimated value exceeds one of the threshold values as shown in the period until time t1 in FIG. 11A, number of target SFs Npe can be fixed at 0. In other words, for example, when only Pthd_min independent of the power change direction is provided, number of target SFs Npe varies between 0 and 1 according to power estimated value PE as shown in FIG. 11A. In contrast, in the plasma display device of this exemplary embodiment, number of target SFs determination circuit 47 determines the number of target SFs based on temperature threshold values, i.e. combinations of threshold values in the temperature increasing and decreasing directions as shown in FIG. 10A, and number of target SFs determination circuit 48 determines the number of target SFs based on power threshold values, i.e. combinations of threshold values in the power increasing and decreasing directions, as shown in FIG. 10B. Thus, variations in number of SFs to be limited Nsf as well as number of target SFs Nte and number of target SFs Npe can be inhibited. This inhibition can suppress flickers in the display image caused by repeated operations of limitation and non limitation of gradations.

Next, image signals that make the lighting states of adjacent discharge cells in an inverted relation and provide an image in a checkered pattern are supplied from time t1 to time t4 of FIGS. 11A, 11B, 11C, and 11D. Input of such image signals increases the number of changes in address pulse voltage as described above, thus increasing the power consumption of each drive IC 521. Because each load calculation circuit 601 detects such an increase in the number of changes, the load values supplied from each load calculation circuit 601 rapidly increase. For this reason, power estimated value PE supplied from power calculation circuit 62 rapidly increases and exceeds power maximum threshold value Pthu_max in number of target SFs determination circuit 48, from time t1 to time t2, as shown in FIG. 11A. As a result, as shown in FIG. 11B, in the period from time t1 to time t2, number of target SFs determination circuit 48 outputs 1, 3, and 8 in this order, as numbers of target SFs Npe.

On the other hand, each accumulator 611 in temperature calculation circuit 61 performs cumulative operations on the load values supplied from corresponding load calculation circuit 601. Thus, as shown in FIG. 11A, temperature estimated value TE not rapidly but slowly increases after time t1. For this reason, as shown in FIG. 11C, in the period from time t1 to time t2, number of target SFs determination circuit 47 outputs 0 as number of target SFs Nte.

Maximum value detector 433 detects the larger one of number of target SFs Npe and number of target SFs Nte. Thus, as shown in FIG. 11D, in the period from time t1 to time t2, maximum value detector 433 selects numbers of target SFs Npe, and outputs a conversion control data for showing 1, 3, and 8 in this order as numbers of SFs to be limited Nsf. Because second image converter 42 receives the conversion control data for setting 1, 3, and 8 in this order as numbers of SFs to be limited Nsf, the second image converter changes the image data supplied from first image converter 41 into an image data in which address operation is stopped by the number of SFs based on number of SFs to be limited Nsf. In other words, when number of SFs to be limited Nsf is 1, second image converter 42 sets the first SF to be limited and converts the image data supplied from first image converter 41 into an image data according to a changed coding in which no address operation is to be performed in the first SF. Similarly, when number of SFs to be limited Nsf is 3, the second image converter sets the first to the third SFs to be limited, and converts the image data supplied from first image converter 41 into an image data according to a changed coding in which no address operation is to be performed in the first to the third SFs. When number of SFs to be limited Nsf is 8, second image converter 42 sets the first to the eighth SFs to be limited, and converts the image data supplied from first image converter 41 into an image data according to a changed coding in which no address operation is to be performed in the first to the eighth SFs. In this manner, when image signals that rapidly increase power consumption are supplied, in response to the rapid increase in power consumption, second image converter 42 changes the received image data supplied from first image converter 41 into an image data that rapidly decreases the power consumption by feedback control through power calculation circuit 62.

In this manner, in the period from time t1 to time t2, by feedback control through power calculation circuit 62, the first to the eighth SFs are set to be limited and the image data supplied from first image converter 41 is changed into an image data that rapidly reduces the power consumption. Thus, the power consumption of each drive IC 521 having rapidly increased once begins to decrease from around time t2. In other words, from time t2 to time t3, the operation of feedback control through power calculation circuit 62 still continues. The power consumption of each drive IC 521 gradually decreases. Accordingly, power estimated value PE gradually decreases, and number of target SFs Npe gradually decreases to 6 and 5 as shown in FIG. 11B.

On the other hand, an increase in the power consumption caused by the change of image signals after time t1 gradually increases the temperature of each drive IC 521 from around time t2. With this increase, temperature estimated value TE gradually increases. For this reason, as shown in FIG. 11A, temperature estimated value TE exceeds temperature minimum threshold value Tthu_min in number of target SFs determination circuit 47. Thus, as shown in FIG. 11C, from around the midterm between time t2 and time t3, number of target SFs determination circuit 47 outputs 1, 2, and 3 in this order, as numbers of target SFs Nte.

When number of target SFs Npe and number of target SFs Nte are compared with each other in the period from time t2 to time t3, number of target SFs Npe is still larger as shown in FIGS. 11B and 11C. Thus, maximum value detector 433 selects the larger number, i.e. number of target SFs Npe, also in the period from time t2 to time t3, and outputs 6 and 5 in this order as a conversion control data showing numbers of SFs to be limited Nsf, as shown in FIG. 11D. Further, second image converter 42 outputs an image data in which address operation is stopped in the target SFs according to such numbers of SFs to be limited Nsf. In this manner, even after image signals rapidly increasing the power consumption are supplied as shown in the period from time t2 to time t3, feedback control through power calculation circuit 62 causes the operation for gradually decreasing the power consumption of each drive IC 521.

In the period from time t3 to time t4, the above feedback control substantially stabilizes the power consumption of each drive IC 521, power estimated value PE, and number of target SFs Npe at certain values. On the other hand, the temperature of each drive IC 521 is continuously and gradually increased for the time being even after time t3 by the increase in the power consumption from time t1. With this increase, temperature estimated value TE and number of target SFs Nte gradually increase. For this reason, as shown in FIGS. 11B and 11C, after time t3, number of target SFs Nte is larger than number of target SFs Npe. Thus, maximum value detector 433 selects number of target SFs Nte, and outputs 5, 6, and 5 in this order as a conversion control data showing numbers of SFs to be limited Nsf, as shown in FIG. 11D. Further, second image converter 42 converts the image data supplied from first image converter 41 into an image data in which no address operation is performed in some SFs according to such numbers of SFs to be limited Nsf, and outputs the converted image data. In this manner, when a period of time has elapsed after input of image signals increasing the power consumption, the control mode is changed to feedback control through temperature calculation circuit 61 to cause the operation for suppressing the temperature increase as well as power consumption of each drive IC 521. Like conversion control data generator 46, a structure in which maximum value detector 433 obtains the larger value of number of target SFs Npe based on power consumption and number of target SFs Nte based on temperature allows the power consumption of each drive IC 521 to be suppressed on the basis of at least one of power consumption and temperature. Further, the feedback control of power consumption and the feedback control of temperature can be switched with a simplified structure.

As described above, when image signals increasing the power consumption of data electrode driver circuit 52 are supplied in the period from time t1 to time t4, first, the plasma display device of this exemplary embodiment promptly responds to increases in the power consumption and operates to rapidly decrease the power consumption by feedback control through power calculation circuit 62 that suppresses the power consumption. Thereafter, the plasma display device responds to the gradually increasing temperature and operates to suppress increases in the temperature as well as power consumption by feedback control through temperature calculation circuit 61 that suppresses the temperature increase. With these operations, when image signals increasing the power consumption are supplied, the plasma display device of this exemplary embodiment more promptly suppresses the power consumption and thereby temperature increase than the method of decreasing the temperature of the data electrode driver circuit by temperature feedback control.

When the display image is changed to a normal image at time t4, the number of changes in address pulse voltage decreases. Thus, the load values supplied from each load calculation circuit 601 decrease. With this decrease, power estimated value PE and number of target SFs Npe decrease, and temperature estimated value TE and number of target SFs Nte decrease slowly. Thereafter, when number of SFs to be limited Nsf decreases to 0 in the conversion control data, image signal conversion circuit 400 supplies the image data according to the predetermined coding as shown in FIG. 5A in blocks to respective drive ICs 521 of data electrode driver circuit 52. Panel 10 displays an image according to the predetermined coding in which all the SFs are subjected to address operation.

Figure 12A:
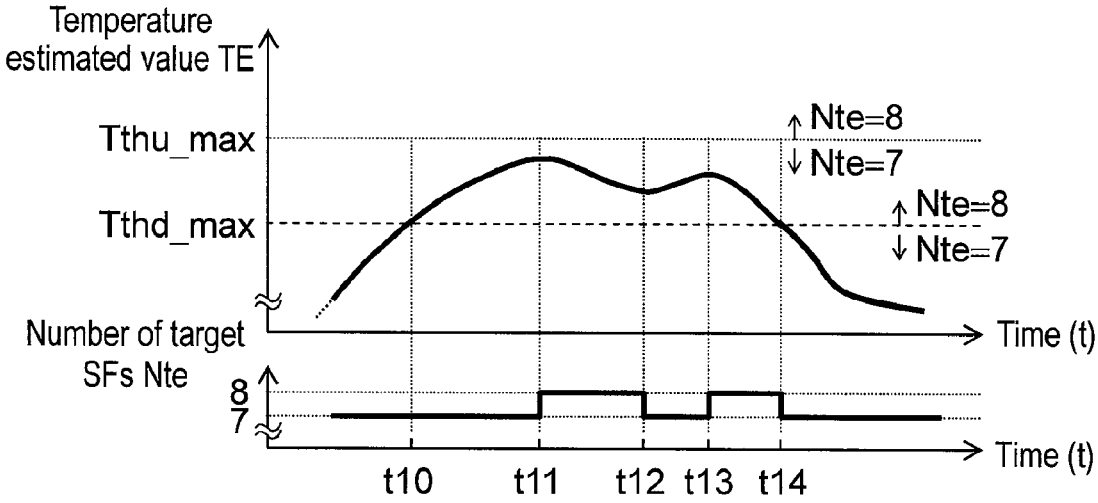
FIG. 12A is a diagram showing how the value of number of target subfields Nte oscillates when temperature estimated value TE repeats increases and decreases between temperature threshold value Tthu and temperature threshold value Tthd in accordance with the second exemplary embodiment of the present invention.

In the above structure, repeated increases and decreases in temperature estimated value TE between a combination of temperature threshold value Tthu and temperature threshold value Tthd cause number of target SFs Nte to oscillate according to this repetition, because number of target SFs Nte is determined according to the threshold values corresponding to the increase and decrease. FIG. 12A is a diagram showing how the value of number of target SFs Nte oscillates when temperature estimated value TE repeats increases and decreases between such two threshold values. FIG. 12A shows a case where temperature estimated value TE repeats increases and decreases between temperature maximum threshold value Tthu_max and temperature maximum threshold value Tthd_max, as an example. In other words, when temperature estimated value TE is equal to or smaller than temperature maximum threshold value Tthu_max in a direction in which temperature estimated value TE increases as shown in the period until till in FIG. 12A, number of target SFs Nte is 7. When temperature estimated value TE exceeds temperature maximum threshold value Tthu_max, number of target SFs Nte is 8. On the other hand, when temperature estimated value TE exceeds temperature maximum threshold value Tthd_max in a direction in which temperature estimated value TE decreases as shown in the period from time t11 to time t12, number of target SFs Nte is 8.

Then, when temperature estimated value TE is equal to or smaller than Tthd_max as shown in the period after time t14, number of target SFs Nte is 7. For this reason, when temperature estimated value TE exceeds temperature maximum threshold value Tthd_max and is equal to or smaller than temperature maximum threshold value Tthu_max as shown in the period from time t10 to time t14, number of target SFs Nte varies between 7 and 8 as shown in FIG. 12A depending on an increase or decrease in temperature estimated value TE. Such variations cause flickers in the display image and degrade the image quality.

Figure 12B:
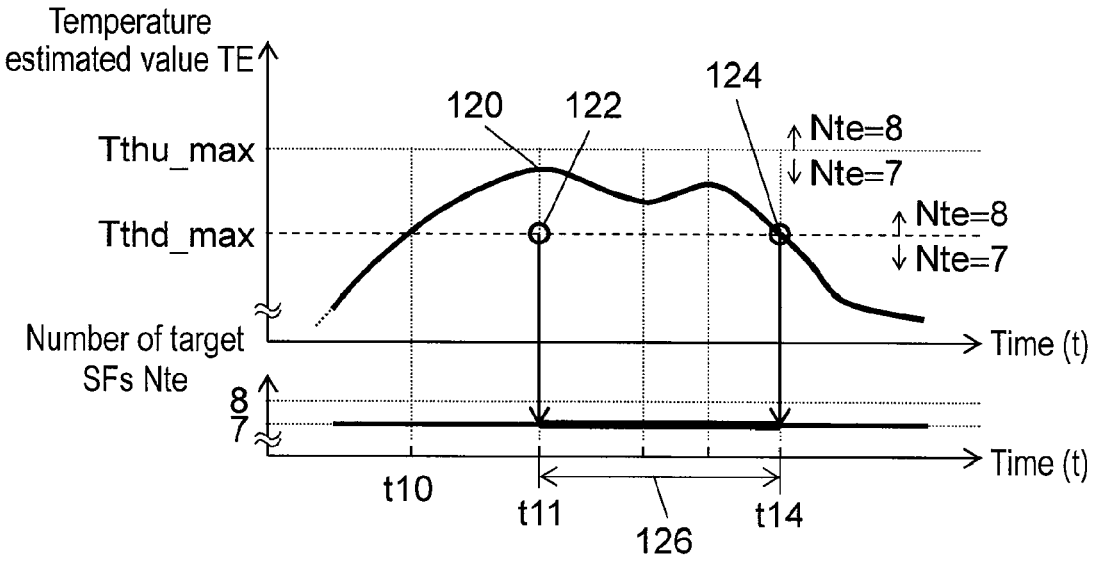
FIG. 12B is a diagram showing an example of processing for inhibiting oscillation of number of target subfields Nte in the above case.

FIG. 12B is a diagram showing an example of processing for inhibiting oscillation of number of target SFs Nte when temperature estimated value TE repeats increases and decreases between temperature threshold value Tthu and temperature threshold value Tthd. In this processing, as shown in FIG. 12B, first, it is detected at time t10 that temperature estimated value TE has increased and exceeded temperature threshold value Tthd_max and reached a value between temperature threshold value Tthu_max and temperature threshold value Tthd_max. After this detection, in the period in which temperature estimated value TE is between temperature threshold value Tthu_max and temperature threshold value Tthd_max (from time t10 to t14), detection of whether temperature estimated value TE is inverted from an increase to a decrease, and detection of whether temperature estimated value TE is equal to or smaller than temperature threshold value Tthd_max are started. In other words, as shown in FIG. 12B, inversion of temperature estimated value TE from an increase to a decrease (shown by reference numeral 120) is detected. Unless temperature estimated value TE is equal to or smaller than temperature threshold value Tthd_max (at time t11), the continuous use of current temperature threshold value Tthu_max as a temperature threshold value for determining number of target SFs Nte is started (as shown by reference numeral 122). Thereafter, the use of Tthu_max as a temperature threshold value for determining number of target SFs Nte is continued until temperature estimated value TE reaches a value equal to or smaller than temperature threshold value Tthd_max. When temperature estimated value TE reaches a value equal to or smaller than temperature threshold value Tthd_max (at time t14), the use of temperature threshold value Tthu_max is stopped (as shown by reference numeral 124). In other words, the period from time till to time t14 is shown as period 126 in which the use of temperature threshold value Tthu_max is continued. Such a processing can fix number of target SFs Nte at 7 as illustrated in FIG. 12B, and inhibit problems such as variations in number of target SFs Nte between 7 and 8.

FIG. 12B shows an example of a case where temperature estimated value TE increases and reaches values between temperature maximum threshold value Tthu_max and temperature maximum threshold value Tthd_max. However, this example is also applicable to a case where temperature estimated value TE takes values between temperature threshold value Tthu and temperature threshold value Tthd of each combination. At a decrease in temperature estimated value TE, inversion of the above processing can inhibit variations in number of target SFs Nte in a similar manner. In the inverted processing, first, it is detected that temperature estimated value TE has decreased and reached a value equal to or smaller than temperature threshold value Tthu, between temperature threshold value Tthu and temperature threshold value Tthd. After this detection, in the period in which temperature estimated value TE is between temperature threshold value Tthu and temperature threshold value Tthd, detection of whether temperature estimated value TE is inverted from a decrease to an increase, and detection of whether temperature estimated value TE is equal to or larger than temperature threshold value Tthu are started. When temperature estimated value TE is inverted from a decrease to an increase and is smaller than temperature threshold value Tthu, the use of current temperature threshold value Tthd is continued as a temperature threshold value for determining number of target SFs Nte. Thereafter, the use of temperature threshold value Tthd as a temperature threshold value for determining number of target SFs Nte is continued until temperature estimated value TE reaches a value equal to or larger than temperature threshold value Tthu. When temperature estimated value TE reaches a value equal to or larger than temperature threshold value Tthu, the use of temperature threshold value Tthd is stopped. With such a processing, this method can be applied to a case in which temperature estimated value TE decreases in contrast to the case of FIG. 12B. In the above description, an example of processing with respect to temperature estimated value TE is given. However, processing with respect to power estimated value PE in a similar manner can further suppress variations in number of target SFs Npe caused by power estimated value PE.

As described above, the plasma display device of this exemplary embodiment includes power calculation circuit 62 for calculating a power consumption of data electrode driver circuit 52 according to an image data, and temperature calculation circuit 61 for calculating a temperature of data electrode driver circuit 52 according to the image data. The plasma display device further includes temperature change detection circuit 63 for detecting a temperature change direction of whether the calculated temperature is increased or decreased per unit time, and power change detection circuit 64 for detecting a power change direction of whether the calculated power is increased or decreased per unit time. At least when the calculated power consumption exceeds the first power threshold value, or when the calculated temperature exceeds the first temperature threshold value, image signal conversion circuit 400 converts the image signal into an image data decreasing the power consumption of data electrode driver circuit 52. At least when the calculated power consumption is equal to or smaller than the second power consumption, or when the calculated temperature is equal to or smaller than the second temperature threshold value, image signal conversion circuit 400 converts the image signal into an image data increasing the power consumption of data electrode driver circuit 52. As described above, the plasma display device may be structured so that one of the power consumption and temperature is determined according not to the threshold values corresponding to the change direction but to whether the value is larger than the predetermined threshold value. With such a structure, when image signals increasing the power consumption are supplied, the plasma display device of this exemplary embodiment, first, rapidly decreases the power consumption by feedback control through power calculation circuit 62 that suppresses power consumption. Thereafter, the plasma display device suppresses an increase in temperature as well as power consumption by feedback control through temperature calculation circuit 61 that suppresses the temperature increase. Further, in the plasma display device of this exemplary embodiment, image signal conversion circuit 400 converts the image data into an image data decreasing the power consumption, according to the predetermined power threshold value corresponding to the power change direction or the predetermined temperature threshold value corresponding to the temperature change direction. This structure can inhibit variations in the conversion control data for controlling conversion of the image data into an image data decreasing the power consumption. This inhibition can suppress flickers in the display image caused by repeated operations of limitation and non limitation of gradations.

Thus, the present invention can provide a plasma display device capable of promptly responding to a rapid increase in power consumption or the like, and making stable operation to display images without causing malfunction of the data electrode driver circuit.

For ease of explanation, the above description gives an example of a structure in which number of target SFs Npe based on the load value calculated by each load calculation circuit 601 is fed back without delay. However, in order to inhibit oscillating response characteristics, an element, such a simple loop filter having a small time constant, may be added as appropriate. Further, the following structure may be used to achieve the rapid rising characteristics of number of target SFs Npe in the period from time t1 to time t2 as shown in FIG. 7B and FIG. 11B. For this purpose, the maximum number of target SFs Npe and the number of changes per field in the number of target SFs are preset, and a threshold value of power estimated value PE is provided. When power estimated value PE exceeds this threshold value, number of target SFs Npe that changes to the maximum number by the above number of changes is fed to second image converter 42 for each field.

The description in each of the first and second exemplary embodiments gives an example of a structure in which each of temperature estimated value TE and power estimated value PE based on the load value calculated by each load calculation circuit 601 is fed back to change a predetermined coding into a coding decreasing the power consumption. However, the present invention is not limited to this structure and the following structure may be used. For example, temperature estimated value TE is fed back, and power estimated value PE is fed forward to change a predetermined coding into a coding decreasing the power consumption.

The specific numerical values used in the first and second exemplary embodiments are only examples, and preferably, the values are set optimum for the characteristics of the panel and the specifications of the plasma display device, as appropriate.

INDUSTRIAL APPLICABILITY

The plasma display device of the present invention is capable of promptly responding to a rapid increase in power consumption, and making stable operation to display images without causing malfunction of the data electrode driver circuit. Thus, the present invention is useful as a display device for use in a wall-mounted television or a large monitor.

The invention claimed is:

1. A plasma display device including a plasma display panel that has discharge cells each formed at an intersection between a display electrode pair and a data electrode, one field period of an image signal being divided into a plurality of subfields, the plasma display device displaying an image by causing the discharge cell to be lit or unlit in each of the plurality of subfields, the plasma display device comprising:

an image signal conversion circuit for converting the image signal into an image data for causing the discharge cell to be lit or unlit in each of the subfields;

a data electrode driver circuit for driving the data electrode according to the image data;

a power calculator for informing of a calculated power consumption as power estimated value of the data electrode driver circuit according to the image data; and a temperature calculator for informing of a calculated temperature as a temperature estimated value of the data electrode driver circuit according to the image data, wherein the image signal conversion circuit determines a number of target SFs according to SFs that image data are converted to decrease the power consumption, based on each of the power estimated value and the temperature estimated value, and the image signal conversion circuit converts the image signal into the image data, according to the larger one of the number of target SFs based on the temperature estimated value and the number of target SFs based on the power estimated value.

2. The plasma display device of claim 1, wherein the image signal conversion circuit has a first temperature threshold value, and a second temperature threshold value smaller than the first temperature threshold value, at least when the power estimated value exceeds predetermined power threshold value, or when the temperature estimated value exceeds the first temperature threshold value, the image signal conversion circuit converts the image signal into the image data decreasing the power consumption of the data electrode driver circuit, and at least when the power estimated value is equal to or smaller than the predetermined power threshold value, or when the temperature estimated value is equal to or smaller than the second temperature threshold value, the image signal conversion circuit converts the image signal into an image data increasing the power consumption of the data electrode driver circuit.

3. The plasma display device of claim 1, wherein the image signal conversion circuit has a first power threshold value, and a second power threshold value smaller than the first power threshold value, at least when the power estimated value exceeds the first power threshold value, or when the temperature estimated value exceeds the predetermined temperature threshold value, the image signal conversion circuit converts the image signal into the image data decreasing the power consumption of the data electrode driver circuit, and at least when the power estimated value is equal to or smaller than the second power threshold value, or when the temperature estimated value is equal to or smaller than the predetermined temperature threshold value, the image signal conversion circuit converts the image signal into an image data increasing the power consumption of the data electrode driver circuit.

4. The plasma display device of claim 1, wherein the data electrode driver circuit includes a plurality of drivers corresponding to the data electrodes of the plasma display panel divided into blocks, the power calculator calculates a total power consumption of the plurality of drivers, and the temperature calculator calculates a highest temperature of the plurality of drivers.

5. The plasma display device of claim 1, wherein the image signal conversion circuit reduces the power consumption of the data electrode driver circuit in at least one of the subfields.

* * * * *